US007720418B2

(12) United States Patent
Tanaka et al.

(10) Patent No.: US 7,720,418 B2
(45) Date of Patent: May 18, 2010

(54) TONER CHANGE AND FLOW STABILIZING DEVELOPING DEVICE, PROCESS CARTRIDGE, AND IMAGE FORMING APPARATUS

(75) Inventors: Shinya Tanaka, Tokyo (JP); Shuuichi Endoh, Kanagawa (JP); Masato Iio, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 421 days.

(21) Appl. No.: 11/666,750

(22) PCT Filed: Apr. 25, 2006

(86) PCT No.: PCT/JP2006/309132

§ 371 (c)(1),
(2), (4) Date: May 2, 2007

(87) PCT Pub. No.: WO2006/115298

PCT Pub. Date: Nov. 2, 2006

(65) Prior Publication Data

US 2008/0095553 A1 Apr. 24, 2008

(30) Foreign Application Priority Data

Apr. 26, 2005 (JP) ..... 2005-127317
Apr. 26, 2005 (JP) ..... 2005-127318
Apr. 26, 2005 (JP) ..... 2005-127647

(51) Int. Cl.
*G03G 15/08* (2006.01)

(52) U.S. Cl. ..... 399/263; 399/260

(58) Field of Classification Search ..... 399/260, 399/262, 263
See application file for complete search history.

(56) References Cited

U.S. PATENT DOCUMENTS 4,788,570 A 11/1988 Ogata et al.
4,873,940 A 10/1989 Ishikawa et al.
5,486,909 A 1/1996 Takenaka et al.
5,489,747 A 2/1996 Takenaka et al.
5,548,383 A 8/1996 Endoh
5,552,870 A 9/1996 Murakami et al.

(Continued)

FOREIGN PATENT DOCUMENTS

JP 7 5764 1/1995

(Continued)

OTHER PUBLICATIONS

Machine English translation of JP 2002162817.*

(Continued)

*Primary Examiner*—David M Gray
*Assistant Examiner*—Billy J Lactaoen
(74) *Attorney, Agent, or Firm*—Oblon, Spivak, McClelland, Maier & Neustadt, L.L.P.

(57) ABSTRACT

A developing unit develops a latent image on an image carrier with toner. A toner cartridge is detachably arranged in parallel with the developing unit, and supplies the toner to the developing unit. An opening is disposed between the developing unit and the toner cartridge, through which the toner passes. The toner cartridge includes a space forming unit that forms a space in the toner stored in the toner cartridge. The space allows the toner to flow into from the developing unit.

15 Claims, 18 Drawing Sheets

U.S. PATENT DOCUMENTS

| | | | | |
|---|---|---|---|---|
| 5,610,693 | A | 3/1997 | Sugiyama et al. | |
| 5,617,191 | A | 4/1997 | Murakami et al. | |
| 5,625,438 | A | 4/1997 | Sugiyama et al. | |
| 5,625,440 | A | 4/1997 | Matsumae et al. | |
| 5,625,441 | A | 4/1997 | Sugiyama et al. | |
| 5,666,625 | A | 9/1997 | Komatsubara et al. | |
| 5,689,782 | A | 11/1997 | Murakami et al. | |
| 5,697,026 | A | 12/1997 | Matsumae et al. | |
| 5,708,942 | A | 1/1998 | Sugiyama et al. | |
| 5,768,665 | A | 6/1998 | Yamanaka et al. | |
| 5,826,144 | A | 10/1998 | Takenaka et al. | |
| 5,845,183 | A | 12/1998 | Sugiyama et al. | |
| 5,879,752 | A | 3/1999 | Murakami et al. | |
| 6,033,818 | A | 3/2000 | Sugiyama et al. | |
| 6,321,049 | B1 | 11/2001 | Endoh | |
| 6,643,486 | B1 | 11/2003 | Endoh et al. | |
| 6,775,506 | B2 | 8/2004 | Endoh et al. | |
| 6,795,674 | B2 | 9/2004 | Endoh et al. | |
| 2002/0071694 | A1* | 6/2002 | Sakai et al. | 399/119 |
| 2002/0106222 | A1* | 8/2002 | Chadani et al. | 399/262 |
| 2003/0031479 | A1* | 2/2003 | Ito | 399/27 |
| 2006/0239722 | A1 | 10/2006 | Tanaka et al. | |

FOREIGN PATENT DOCUMENTS

| | | | |
|---|---|---|---|
| JP | 8 122559 | | 5/1996 |
| JP | 8 179608 | | 7/1996 |
| JP | 2002 162817 | | 6/2002 |
| JP | 2002162817 | A * | 6/2002 |
| JP | 3354388 | | 9/2002 |
| JP | 2003 302824 | | 10/2003 |
| JP | 2003 302834 | | 10/2003 |
| JP | 2004 53775 | | 2/2004 |
| JP | 2004 354813 | | 12/2004 |
| JP | 2004354813 | A * | 12/2004 |
| JP | 2005 62215 | | 3/2005 |
| KR | 10-2002-0068210 | | 8/2002 |

OTHER PUBLICATIONS

Machine English Translation of JP 2004354813.*

* cited by examiner

TONER CHANGE AND FLOW STABILIZING DEVELOPING DEVICE, PROCESS CARTRIDGE, AND IMAGE FORMING APPARATUS

TECHNICAL FIELD

The present invention relates to a developing device used for an image formation using an electrostatic copying process, and a process cartridge and an image forming apparatus employing the developing device.

BACKGROUND ART

Office automation is becoming increasingly prevalent, and use of color documents is growing. In the past, office equipment was mainly used for taking copies of documents consisting only of text. Now, documents including graphics such as graphs are prepared in personal computers, printed out from printers, and large amounts of copies are taken to produce presentation materials, for example. Images output from printers include solid images, line images, and halftone images. Thus, demands for image quality are changing, and high reliability is increasingly demanded.

Electrophotographic methods such as electrostatic recording and electrostatic printing include a developing process for developing an electrostatic image on an image carrier such as a photoconductor by applying a developer to the photoconductor, a transfer process for transferring the developed image from the photoconductor to a transfer medium such as paper, and a fixing process for fixing the image onto the paper. There are two types of developers for developing the electrostatic image formed on the photoconductor, i.e., a two-component developer including carriers and toner, and a single-component developer, which does not require carriers, including only magnetic toner or nonmagnetic toner. The two-component developer has the following disadvantages: the developer deteriorates as toner particles stick to the surfaces of the carriers; and a mixture of the toner and the carriers needs to be maintained at a certain ration, so that toner density in the developer does not decrease as the toner is consumed. Accordingly, a large-sized developing device is needed to realize such a configuration. On the other hand, the single-component developer is advantageous in that the developing device can be made compact, and that the developer can be used under any temperature or humidity conditions. Accordingly, the single-component developer is becoming a mainstream.

There are two types of single-component developers, i.e., a magnetic single-component developer including magnetic toner, and a nonmagnetic single-component developer including nonmagnetic toner. In a magnetic single-component developing method employing the magnetic single-component developer, a developing sleeve with a magnetic field generator such as a magnet provided inside holds the magnetic toner including magnetic substances such as magnetite, and a layer thickness restricting member reduces the thickness of the toner for the developing process. The magnetic single-component developer is widely used in compact printers. In a nonmagnetic single-component developing method employing the nonmagnetic single-component developer, the toner does not have a magnetic force, and therefore, a toner supplying roller is pressed against a developing sleeve to supply the toner to the developing sleeve, and the developing sleeve holds the toner by static electricity. A layer thickness restricting member reduces the thickness of the toner for the developing process. Because the toner does not include chromatic magnetic substances, the nonmagnetic single-component developer is useful for producing color images, and because the developing sleeve does not include a magnet, a light-weight, low-cost developing device can be realized. Accordingly, the nonmagnetic single-component developer is widely used in compact, full-color printers.

However, the single-component developing method has many problems to be solved. In the two-component developing method, the carriers are used to electrically charge and convey the toner. The toner and the carriers are sufficiently mixed and stirred together, and then conveyed to the developing sleeve for the developing process. Therefore, the two-component developer can be steadily charged and conveyed over a long time, and can be used in a high-speed developing device. On the other hand, the single-component developing method does not employ carriers that can steadily charge and convey the toner, and therefore, failures occur in the charging and conveying operations when the developing device is used over a long time or at a high speed.

Particularly in the nonmagnetic single-component developing method, the toner contacts friction-charged members such as the developing sleeve or the layer thickness restricting member only for a very short time. Therefore, there is a higher chance of creating low charged toner or reversely charged toner than in the two-component developing method. Furthermore, the layer thickness of toner on a toner conveying member, which conveys the toner to the image carrier, needs to be as thin as possible. Accordingly, the toner conveying member receives a force from the layer thickness restricting member, which pushes outer additives on the surface of the toner particles inside the toner particles. This significantly deteriorates the chargeability and the flowability of the toner.

To solve the above problems, technologies are disclosed in, for example, Japanese Patent Application Laid-Open No. H08-122559 and Japanese Patent Application Laid-Open No. 2005-062215.

DISCLOSURE OF INVENTION

Problem to be Solved by the Invention

However, with the conventional technologies, it is difficult to stabilize chargeability and flowability of toner, particularly a nonmagnetic single-component developer, in a developing device over a long time.

The present invention has been made in view of the above problem, and it is an object of the invention to provide a developing device that can prevent decreases in the chargeability and the flowability of toner in the developing device, particularly a nonmagnetic single-component developer, so that an image forming apparatus employing the developing device can produce high quality images over a long time.

Means for Solving Problem

To solve the above problems and to achieve the above objects, a developing device according to one aspect of the present invention includes a developing unit that develops a latent image on an image carrier with toner; a toner cartridge that is detachably arranged in parallel with the developing unit, and supplies the toner to the developing unit; and an opening that is disposed between the developing unit and the toner cartridge, through which the toner passes. The toner cartridge includes a space forming unit that forms a space in the toner stored in the toner cartridge.

An image forming apparatus according to another aspect of the present invention includes a charging unit that charges a surface of an image carrier that carries a latent image; an exposing device that forms an electrostatic latent image on the surface of the image carrier charged by the charging unit; a developing device that visualizes the electrostatic latent image formed on the surface of the image carrier, to form a visual image; a transferring device that transfers the visible image from the image carrier onto a recording medium directly or via intermediate transfer member; and a fixing device that fixes the visible image transferred onto the recording medium by using a heat or a pressure. The developing device includes a developing unit that develops the latent image on the image carrier with toner; a toner cartridge that is detachably arranged in parallel with the developing unit, and supplies the toner to the developing unit; and an opening that is disposed between the developing unit and the toner cartridge, through which the toner passes. The toner cartridge includes a space forming unit that forms a space in the toner stored in the toner cartridge.

A process cartridge according to still another aspect of the present invention integrally supports at least an image carrier and a developing device, and is detachably attached to an image forming apparatus. The developing device includes a developing unit that develops a latent image on the image carrier with toner; a toner cartridge that is detachably arranged in parallel with the developing unit, and supplies the toner to the developing unit; and an opening that is disposed between the developing unit and the toner cartridge, through which the toner passes. The toner cartridge includes a space forming unit that forms a space in the toner stored in the toner cartridge.

A developing device according to still another aspect of the present invention includes a developing unit that develops a latent image on an image carrier with toner; a toner cartridge that is detachably arranged in parallel with the developing unit, the toner cartridge supplying the toner to the developing unit; an opening that is disposed between the developing unit and the toner cartridge, through which the toner passes; and a control valve that controls an amount of the toner that passes through the opening.

An image forming apparatus according to still another aspect of the present invention includes a charging unit that charges a surface of an image carrier that carries a latent image; an exposing device that forms an electrostatic latent image on the surface of the image carrier charged by the charging unit; a developing device that visualizes the electrostatic latent image formed on the surface of the image carrier, to form a visual image; a transferring device that transfers the visible image from the image carrier onto a recording medium directly or via intermediate transfer member; and a fixing device that fixes the visible image transferred onto the recording medium by using a heat or a pressure. The developing device includes a developing unit that develops a latent image on an image carrier with toner; a toner cartridge that is detachably arranged in parallel with the developing unit, and supplies the toner to the developing unit; an opening that is disposed between the developing unit and the toner cartridge, through which the toner passes; and a control valve that controls an amount of the toner that passes through the opening.

A process cartridge according to still another aspect of the present invention integrally supports at least an image carrier and a developing device, and is detachably attached to an image forming apparatus. The developing device includes a developing unit that develops a latent image on an image carrier with toner; a toner cartridge that is detachably arranged in parallel with the developing unit, and supplies the toner to the developing unit; an opening that is disposed between the developing unit and the toner cartridge, through which the toner passes; and a control valve that controls an amount of the toner that passes through the opening.

EFFECT OF THE INVENTION

The developing device and the image forming apparatus according to an embodiment of the present invention are able to maintain chargeability of toner, so that high-quality images can be produced over a long time. Moreover, flowability of toner is prevented from decreasing, so that images of high density can be steadily produced over a long time.

EXPLANATIONS OF LETTERS OR NUMERALS

Figure 1A:
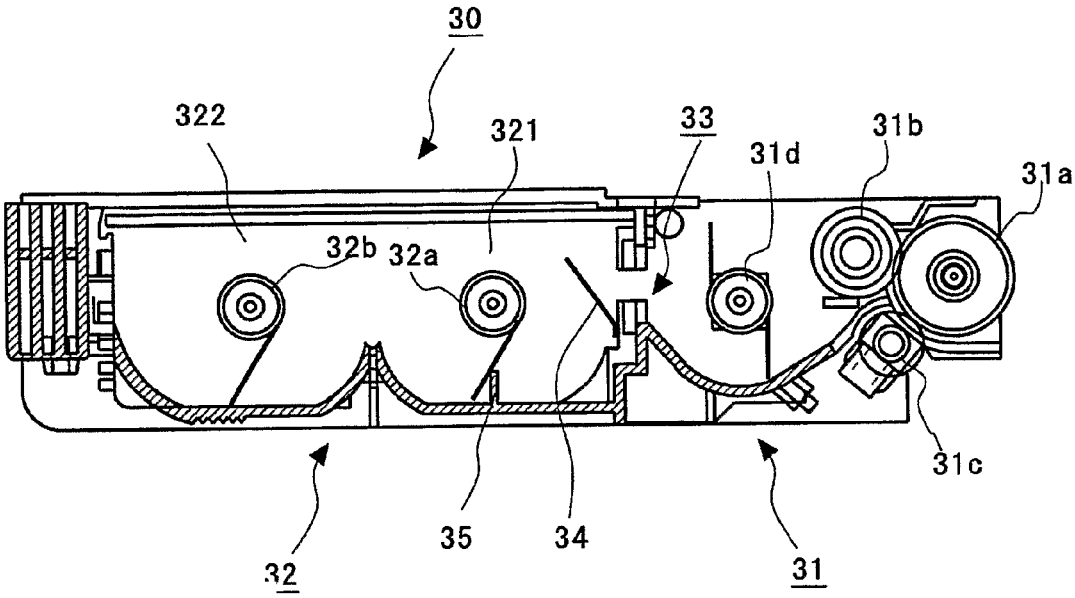
FIG. 1A is a schematic of a developing device according to a first embodiment of the present invention.

1 image forming apparatus
10 photoconductor unit
11 photoconductive belt
12 photoconductor cleaning device
13 charging roller
14 driving roller
15 primary transfer opposite roller
16 extension roller
20 writing optical device
21 semiconductor laser
22 polygon mirror
23*a*, 23*b*, 23*c* reflecting mirrors
30, 300 developing device
31 developing unit
  31*a* developing sleeve
  31*b* supplying roller
  31*c* restricting roller
  31*d*, 310*d* first conveying paddle
  311, 312 film
  31*e* slide shutter
  31*f* elastic member
  31*g* windows
32 toner cartridge
  321 first storage space
  322 second storage space
  32*a* second conveying paddle
  32*b* third conveying paddle
  32*c* elastic member
  32*d* slide shutter
  32*e* fixing seal
33 communicating opening
34, 340 control valve
  34*a* support unit
  34*b* elastic resin films
35 rib
40 intermediate transfer device
41 intermediate transfer belt
42 belt cleaning device
43 position detecting sensor
44 driving roller
45 primary transfer roller
46 secondary transfer opposite roller
47 cleaning opposite roller
48 tension roller
49 toner waste tank
50 secondary transfer device
51 secondary transfer roller
60 fixing device
61 fixing belt
62 pressurizing roller
65 duplex changeover claw
70 paper reversing device
71 reverse changeover claw
72 pair of reverse rollers
80 transfer paper cassette
81*a*, 81*b*, 81*c* paper feeding rollers
82 pair of registration rollers
83 manual feed tray
84 paper discharge tray
90 transfer sheet

BEST MODE(S) FOR CARRYING OUT THE INVENTION

Exemplary embodiments of the present invention will be described in detail below with reference to accompanying drawings. The present invention is not limited to the embodiments.

Figure 1B:
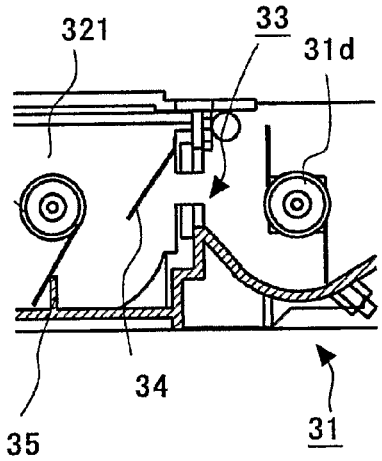
FIG. 1B is a schematic of another example of the developing device according to the first embodiment.

FIGS. 1A and 1B are schematics of a developing device 30 according to a first embodiment of the present invention. The developing device 30 includes a developing unit 31 that develops a latent image on a photoconductive belt 11 (see FIG. 6), which is an image carrier, and a toner cartridge 32 that supplies toner to the developing unit 31.

The developing unit 31 faces the photoconductive belt 11, and includes a developing sleeve 31*a* that is a developer carrier for conveying toner to a developing area formed between the photoconductive belt 11, a supplying roller 31*b* that supplies toner onto the developing sleeve 31*a*, a restricting roller 31*c* that is a layer thickness restricting member for restricting the amount of toner on the developing sleeve 31*a*, and a first conveying paddle 31*d* that is a rotating body for conveying the toner.

The toner cartridge 32 includes a first storage space 321 and a second storage space 322 configured to store therein toner, a second conveying paddle 32*a* and a third conveying paddle 32*b* for conveying toner to the developing unit 31, a rib 35 that is a plate member that protrudes from the bottom of the toner cartridge 32 beneath the second conveying paddle 32*a*, and a control valve 34 that is a movable plate member for blocking a communicating opening 33.

A single-component developer is used as the developer. When replacing deteriorated toner with fresh toner, in the case of a two-component developer, it is difficult to separate toner from carriers once they are mixed together. In the case of the single-component developer, the same kind of toner is stored in the toner cartridge 32 and the developing unit 31, and can therefore be easily replaced. Thus, the developing device 30 can employ the single-component developer. It is particularly preferable to use a nonmagnetic single-component developer. When outer additives on the surface of toner particles of the nonmagnetic single-component developer decrease, chargeability and flowability of the toner decrease, thereby deteriorating developing properties. However, in the developing device 30, a stable amount outer additives can be maintained on the surface of toner particles.

The developing unit 31 and the toner cartridge 32 are horizontally juxtaposed in the developing device 30. Toner passes through the communicating opening 33 between the developing unit 31 and the toner cartridge 32.

When toner is consumed in the developing unit 31, fresh toner is supplied from the toner cartridge 32 to the developing unit 31 through the communicating opening 33. Deteriorated toner is discharged from the developing unit 31 to the toner cartridge 32 through the communicating opening 33.

The toner on the developing sleeve 31*a* receives suppress strength from the supplying roller 31*b* and the restricting roller 31*c*. Accordingly, asperities on the surface of toner particles are crushed, and the surface becomes smooth. As a result, adherence of the toner increases so that the toner adheres more strongly to the photoconductive belt 11, which makes it hard to clean the toner off. Although transferring properties improve when humidity in the environment decreases, cleaning failures occur, and a fog appears in a white background. Furthermore, the suppress strength pushes outer additives on the surface of toner particles inside the toner particles, because the outer additives are harder than the toner. A decrease in the amount of outer additives on the surface of a toner particle changes chargeability of the toner. For example, when silica is used as the outer additive, the toner is highly charged because silica has a large specific surface area. Therefore, chargeability of toner decreases significantly if the silica is pushed inside the toner particles. Moreover, flowability of the toner decreases when the outer additives are pushed inside the toner particles. Flowability affects the adherence of the toner, and therefore, when flowability is high, adherence between the toner and the photoconductive belt 11 decreases. High flowability also decreases the adherence between the toner and the developing sleeve 31*a*, so that developing properties improve. As amounts of the outer additives on the surfaces of the toner particles decrease, the flowability decreases, thereby deteriorating developing properties.

In the developing device 30, toner that is deteriorated after consumption in the developing unit 31 is discharged to the toner cartridge 32 through the communicating opening 33. The deteriorated toner is mixed with fresh toner present in the toner cartridge 32 so that the ratio of deteriorated toner is decreased, and the mixture is then supplied to the developing unit 31 through the communicating opening 33.

The developing device 30 includes a space forming unit that forms a space in the toner stored in the toner cartridge 32. The toner gradually fills the space formed in the toner cartridge 32, as the toner cartridge 32 is shaken by an image forming operation of an image forming apparatus, or by the gravity of the toner. To prevent this, the toner is periodically stirred to form a space inside the toner cartridge 32. Accordingly, the flowability of the toner is prevented from decreasing.

Figure 2:
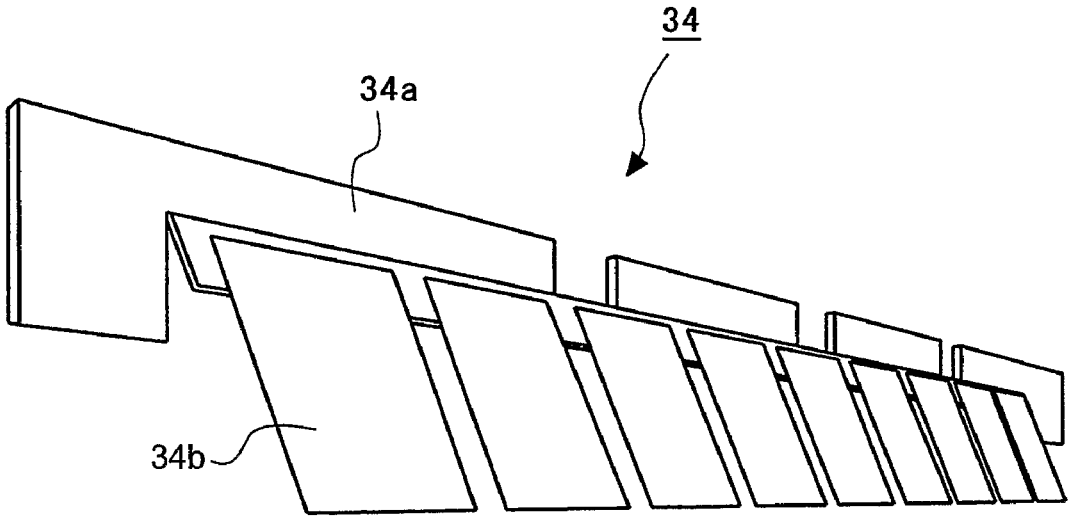
FIG. 2 is a detailed schematic of a control valve in the developing device according to the first embodiment.

The space forming unit causes toner to flow from the developing unit 31 into the space formed in the toner cartridge 32. The space forming unit includes the second conveying paddle 32*a* and the control valve 34. The control valve 34 is provided in the toner cartridge 32 at the communicating opening 33. The control valve 34 shown in FIG. 1A opens at the top. The control valve 34 shown in FIG. 1B opens at the bottom. FIG. 2 is a detailed schematic of the control valve 34 in the developing device 30 according to the first embodiment. The control valve 34 is pasted to a support unit 34*a* fixed in a casing of the toner cartridge 32. The control valve 34 includes rectangular plates, which are elastic resin films 34*b*, provided alternately corresponding to the communicating opening 33, so that a plate is not provided where there is no opening. The support unit 34*a* is made of a rigid metal such as SUS, Cu, and Al. The elastic resin films 34*b* are made of polypropylene, polyethylene, polyester resin, fluorine resin, etc.

The toner moves between the toner cartridge 32 and the developing unit 31 through the communicating opening 33. When the toner cartridge 32 is filled with a large amount of toner, it is difficult to discharge toner from the developing unit 31 to the toner cartridge 32. Thus, the space forming unit forms a space in the toner cartridge 32 near the communicating opening 33, so that toner can flow from the developing unit 31 into the toner cartridge 32.

Figure 3:
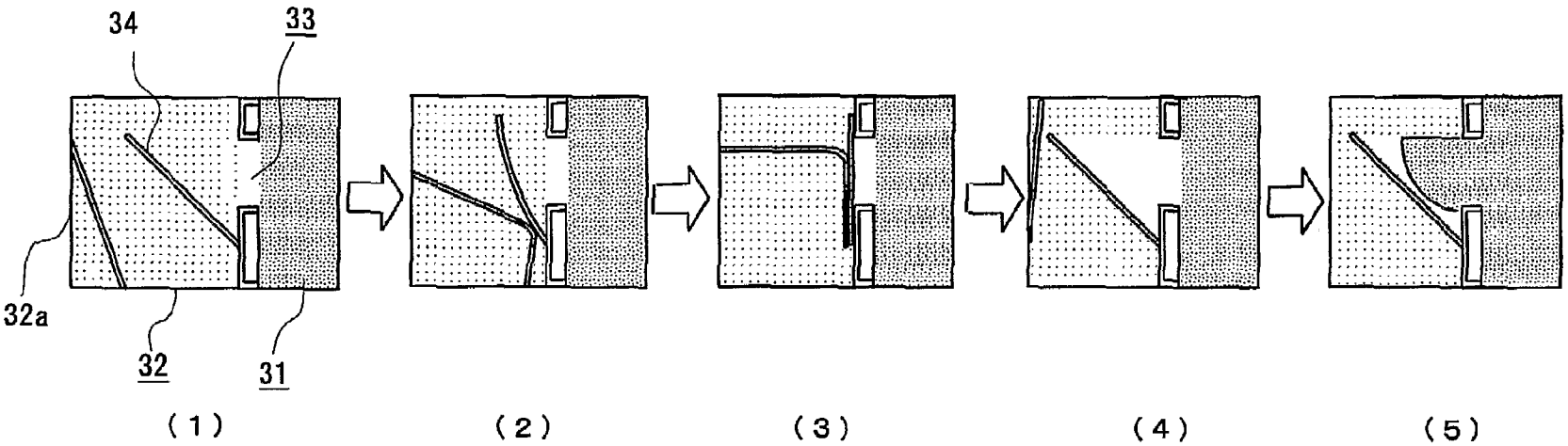
FIG. 3 is a diagram for explaining a space formed in a toner cartridge, and a flow of toner from a developing unit to the toner cartridge in the developing device according to the first embodiment.

FIG. 3 is a diagram for explaining a space formed in the toner cartridge 32, and a flow of toner from the developing unit 31 to the toner cartridge 32 in the developing device 30. As shown in (1), the second conveying paddle 32*a* is long enough to contact the control valve 34. The second conveying paddle 32*a* has a paddling film made of an elastic material such as fluorine resin and silicon resin. As shown in (2), the paddling film rotates and contacts the control valve 34. As shown in (3), the second conveying paddle 32*a* holds down the control valve 34 and blocks the communicating opening 33. As shown in (4), when the second conveying paddle 32*a* passes by and releases the control valve 34, the control valve 34 quickly flips back open by its own elasticity, and forms a space. The control valve 34 moves between an open state and a closed state when contacted by the second conveying paddle 32*a*, thereby forming a space between the control valve 34 and the communicating opening 33.

As shown in (5), toner is drawn into the toner cartridge 32 from the developing unit 31 through the communicating opening 33.

When the second conveying paddle 32*a* holds down the control valve 34 as shown in (2) and (3), toner on the control valve 34 is pushed into the developing unit 31 through the communicating opening 33.

The control valve 34 shown in FIG. 3 opens at the top; however, the control valve 34 can open at the bottom, and move the toner in the same manner.

The second conveying paddle 32*a* includes one bendable paddling film, and the rotation frequency is 0.04 hertz to 0.4 hertz. The paddling film is made of resin such as fluorine resin and polyester resin. Fluorine resin is particularly preferable because it has good slipping properties, and has a low friction coefficient. Moreover, the bendable, resin paddling film can be made longer than a paddling film made of a stiff material, because the length of the stiff film would have to be limited in order to rotate inside the toner cartridge 32. Therefore, a space can be formed within the toner without leaving a dead space between the paddling film and the casing of the toner cartridge 32. The second conveying paddle 32*a* includes one paddling film. If there are two paddling films, the toner in the toner cartridge 32 receives excessive pressure, and a space cannot be formed properly. The space needs to be formed for a sufficient time to let the toner from the developing unit 31 move into the space. However, if the toner in the toner cartridge 32 receives pressure, the space is quickly filled with the toner before the space reaches the vicinity of the communicating opening 33.

The rotation frequency of the second conveying paddle 32*a* is 0.04 hertz to 0.4 hertz. If the rotation frequency is less than 0.04 hertz, the space moves too slowly, and by the time the space formed at the bottom of the toner cartridge 32 moves to the vicinity of the communicating opening 33, the space is filled with toner. If the rotation frequency exceeds 0.4 hertz, the toner receives large pressure, and by the time the space formed at the bottom of the toner cartridge 32 moves to the vicinity of the communicating opening 33, the space is filled with toner.

Accordingly, the developing device 30 can form a space in the toner with the second conveying paddle 32*a*, which is a rotating body, in the toner cartridge 32.

Figure 4:
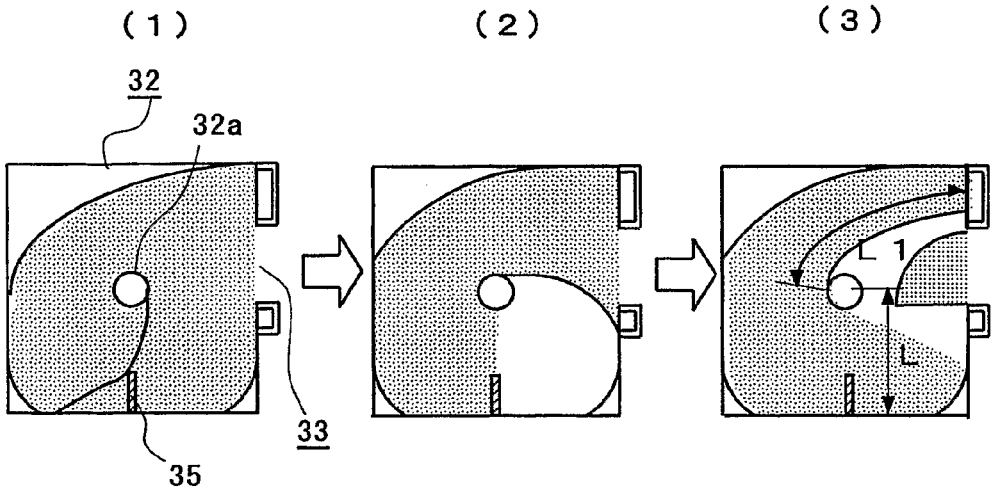
FIG. 4 is another diagram for explaining a space formed in the toner cartridge, and a flow of toner from the developing unit to the toner cartridge the developing device according to the first embodiment.

FIG. 4 is a diagram for explaining a space formed in the toner cartridge 32, and a flow of toner from the developing unit 31 to the toner cartridge 32 in the developing device 30.

The space forming unit described in FIG. 4 includes the second conveying paddle 32*a* and the rib 35, and does not include the control valve 34. As shown in (1), the second conveying paddle 32*a* rotates in the toner cartridge 32. As shown in (2), the second conveying paddle 32*a* contacts the rib 35, and while the rib 35 is blocking toner, the second conveying paddle 32*a* continues rotating, so that a space is formed in the toner. As shown in (3), as toner crosses over the rib 35, and the space reaches the communicating opening 33, toner in the developing unit 31 flows into the toner cartridge 32 by pressure.

The second conveying paddle 32*a* includes one bendable paddling film. The paddling film rotates in contact with inner walls of the toner cartridge 32, conveying toner from an upstream side of a rotational direction to the communicating opening 33, without letting toner slipping into a space formed beneath the paddling film. At the communicating opening 33, the pressure of the toner conveyed by the paddling film is stronger than toner from the developing unit 31, so that the toner is sent into the developing unit 31. Because the paddling film contacts the inner walls of the toner cartridge 32, the toner above the paddling toner is prevented from slipping into the space, so that the space can be maintained for a sufficient time. A length L1 of the paddling film corresponds to 110% to 170% of a length L from the center of the rotating body of the second conveying paddle 32*a* to the inner walls of the toner cartridge 32. If the length L1 is less than 110% of the length L, a dead space is left between the paddling film and the inner walls of the toner cartridge 32. If the length L1 exceeds 170% of the length L, the toner receives pressure for an excessive time. As a result, toner sticks to the inner walls of the toner cartridge 32, and forms a toner film. The toner film becomes thick over time.

After the paddling film passes by the communicating opening 33, the paddling film continues rotating in contact with the inner walls of the toner cartridge 32, so that toner does not flow from the toner cartridge 32 to the developing unit 31, and toner is discharged from the developing unit 31 to the space formed in the toner cartridge 32. Because the toner above the paddling film is prevented from slipping into the space, the size of the space is maintained, so that toner can surely flow into the toner cartridge 32 from the developing unit 31.

Because the space is surely formed for a sufficient time, toner that is well stirred in the developing unit 31 flows into the toner cartridge 32.

The rib 35 is arranged in a range of −30% to +30% of the length L from a position vertically below the second conveying paddle 32*a*.

Figure 5:
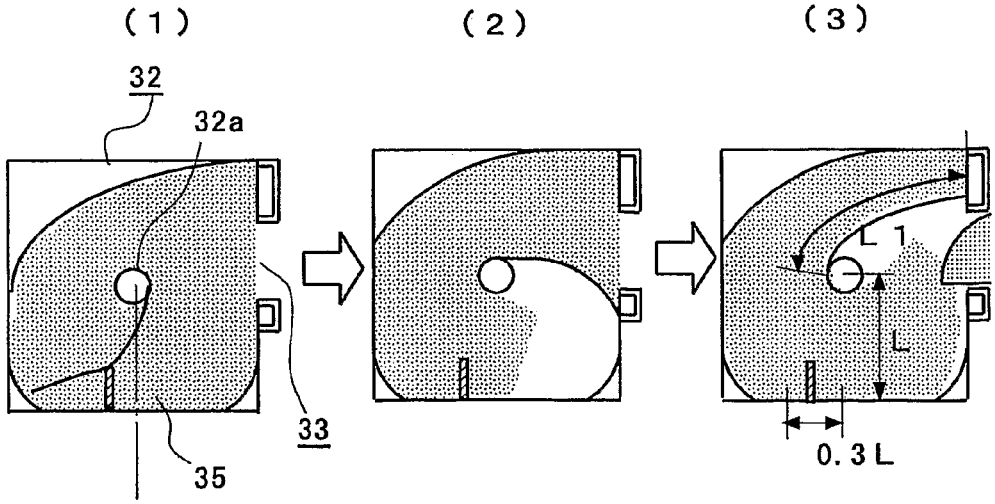
FIG. 5 is still another diagram for explaining a space formed in the toner cartridge, and a flow of toner from the developing unit to the toner cartridge the developing device according to the first embodiment.

FIG. 5 is another diagram for explaining a space formed in the toner cartridge 32, and a flow of toner from the developing unit 31 to the toner cartridge 32 in the developing device 30. An angle at which the paddling film contacts the rib 35 changes according to the position of the rib 35. If the rib 35 is positioned upstream, which is −30% to 0% from the position vertically below the second conveying paddle 32*a*, it is difficult to block the toner and form a space. This decreases the amount of toner that flows from the developing unit 31 to the toner cartridge 32. On the other hand, if the rib 35 is positioned downstream, which is 0% to +30% from the position vertically below the second conveying paddle 32*a*, the space becomes small. This also decreases the amount of toner that flows from the developing unit 31 to the toner cartridge 32.

Accordingly, by arranging the rib 35 within a range of −30% to +30% from the position vertically below the second conveying paddle 32*a*, a large space can be formed, thereby increasing the amount of toner that flows from the developing unit 31 to the toner cartridge 32.

The length of the paddling film of the second conveying paddle 32*a* is longer than a distance from the center of the rotating body of the second conveying paddle 32*a* to the furthest edge of the communicating opening 33 by 10 millimeters or more. An average diameter of toner particles is 10 micrometers or less, and therefore, it is difficult to completely block the toner, regardless of the flowability. In reality, toner slips into the space formed by the paddling film. However, if the paddling film is longer by 10 millimeters or more than the distance from the center of the rotating body to the furthest edge of the communicating opening 33, there is enough time for toner to be discharged from the developing unit 31 into the space formed in the toner cartridge 32 at the communicating opening 33.

More than one communicating opening 33 can provided. By providing plural communicating openings 33, the amount of toner flowing between the developing unit 31 and the toner cartridge 32 can be increased, and the amount of toner can be easily controlled. The communicating openings 33 are arranged in an axial direction, and the shape of each opening is not limited. The shape of each of the communicating openings 33 can be an oval, a rectangle, a diamond, or a parallelogram. Moreover, a mesh can be provided at the communicating opening 33.

Figure 6:
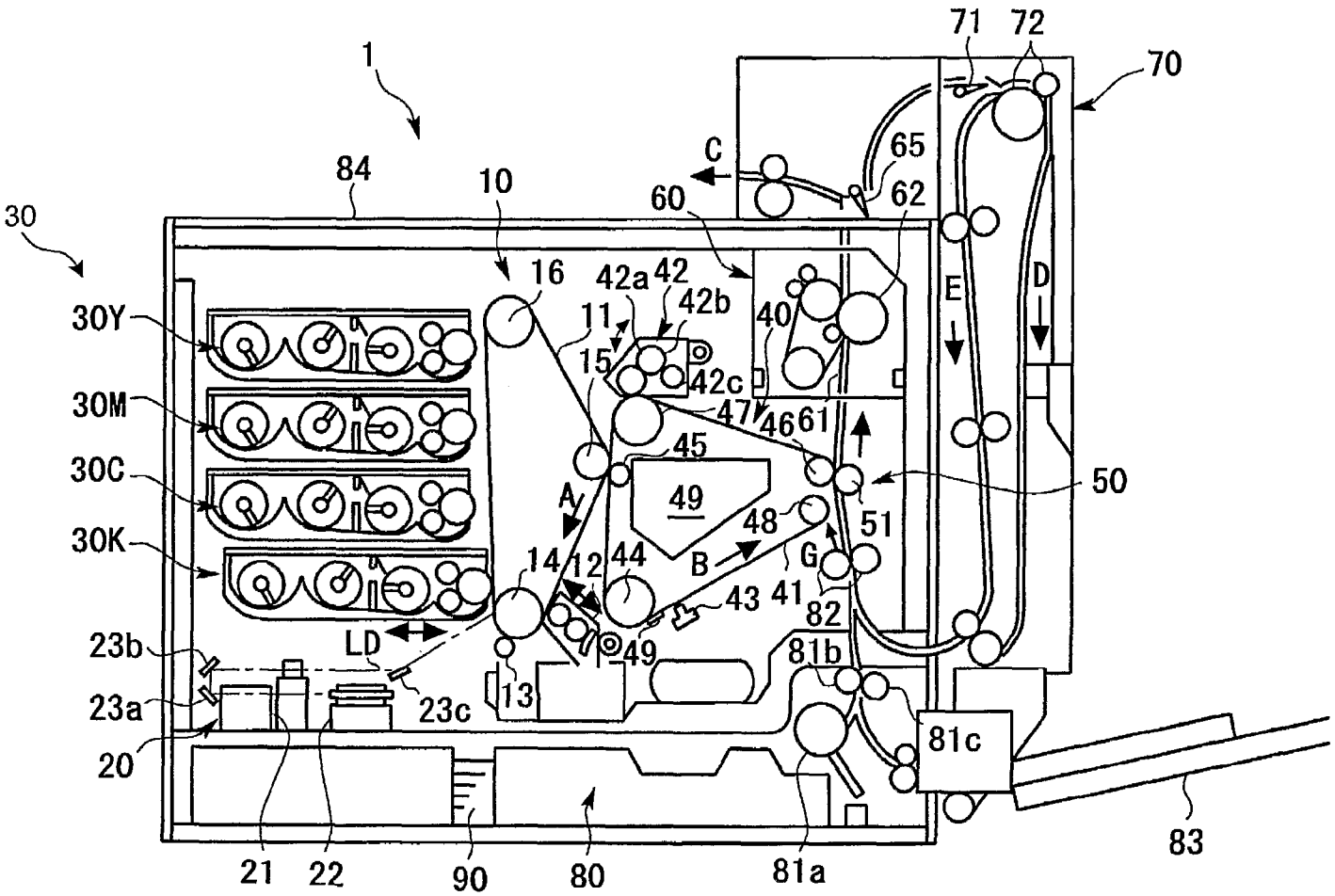
FIG. 6 is a schematic of an image forming apparatus according to the first embodiment.

FIG. 6 is a schematic of an image forming apparatus 1 according to the first embodiment. The image forming apparatus 1 includes a photoconductor unit 10, a writing optical device 20, the developing device 30, an intermediate transfer device 40, a secondary transfer device 50, a fixing device 60, and a paper reversing device 70 used for duplex printing. Color images of black (hereinafter, "Bk"), cyan (hereinafter "C"), magenta (hereinafter, "M"), and yellow (hereinafter, "Y") are sequentially formed on the photoconductive belt 11 of the photoconductor unit 10, and are superposed to form a full-color image. Around the photoconductive belt 11, there are arranged a photoconductor cleaning device 12, a charging roller 13, a plurality of developing devices 30, an intermediate transfer belt 41 of the intermediate transfer device 40. The photoconductive belt 11 is extended around a driving roller 14, a primary transfer opposite roller 15, and an extension roller 16, and is rotated in a direction indicated by an arrow A by a driving motor. The writing optical device 20 converts color image data into optical signals, performs optical writing corresponding to each color image, and forms electrostatic latent images on the photoconductive belt 11. The writing optical device 20 includes a semiconductor laser 21 as a light source, a polygon mirror 22, and three reflecting mirrors 23*a*, 23*b*, and 23*c*.

The developing device 30 includes a Bk developing unit 30K storing black toner, a C developing unit 30C storing cyan toner, an M developing unit 30M storing magenta toner, and a Y developing unit 30Y storing yellow toner, in this order from the lower side of the image forming apparatus 1. These are herein referred to as the developing device 30 when a particular color is not specified. A contact-separation mechanism is provided for moving each developing device to the left and the right as viewed in FIG. 6 so as to contact and separate from the photoconductive belt 11.

Toner inside the developing device 30 is charged to a predetermined polarity, a developing bias is applied to the developing sleeve 31*a* (see FIG. 1A) by a developing bias power source, and the developing sleeve 31*a* is biased to a predetermined potential with respect to the photoconductive belt 11. The contact-separation mechanism includes an electromagnetic clutch, not shown, for communicating a driving force from a motor to each of the developing devices 30. When the electromagnetic clutch is switched on, a driving force moves the developing device 30 toward the photoconductive belt 11. At the developing process, a selected developing device 30 moves to contact the photoconductive belt 11. When the electromagnetic clutch is turned off and the driving force is not communicated, the developing device 30 separates from the photoconductive belt 11.

When the image forming apparatus 1 is in a standby state, the developing device 30 is set at a position separated from the photoconductive belt 11. When the image forming operation starts, optical writing is performed with laser beams based on color image data, and electrostatic latent images are formed (hereinafter, an electrostatic latent image of Bk image data is referred to as a Bk electrostatic latent image; similarly for C, M, and Y). Just before the leading edge of the Bk electrostatic latent image reaches a Bk developing position, a Bk developing sleeve 31*a* starts to rotate, so that the Bk electrostatic latent image is developed with Bk toner. When the trailing edge of the Bk electrostatic latent image passes by the Bk developing position, the Bk developing unit 30K separates from the photoconductive belt 11, and the developing device 30 of the next color contacts the photoconductive belt 11. These operations are completed at least before the leading edge of an electrostatic latent image of the next color reaches the corresponding developing position.

The intermediate transfer device 40 includes the intermediate transfer belt 41, a belt cleaning device 42, and a position detecting sensor 43. The intermediate transfer belt 41 is extended around a driving roller 44, a primary transfer roller 45, a secondary transfer opposite roller 46, a cleaning opposite roller 47, and a tension roller 48, and is driven by a not shown driving motor. A plurality of position detection marks is provided along the rim of the intermediate transfer belt 41, outside an image forming area on the intermediate transfer belt 41. Image formation starts from a time point when the position detecting sensor 43 detects any one of these position detection marks. The belt cleaning device 42 includes a cleaning brush 42*a*, a contact-separation mechanism. While a Bk image, which is the first color image, and the second, third, and fourth color images are being transferred to the intermediate transfer belt 41, the contact-separation mechanism separates the cleaning brush 42*a* from the intermediate transfer belt 41.

The secondary transfer device 50 includes a secondary transfer roller 51 and a contact-separation mechanism that causes, with a clutch etc., the secondary transfer roller 51 to contact and separate from the intermediate transfer belt 41. In synchronization with a timing when a transfer sheet 90 reaches a transfer position, the contact-separation mechanism causes the secondary transfer roller 51 move by pivoting on a rotational axis of the contact-separation mechanism. Accordingly, the transfer sheet 90 is pressed against the intermediate transfer belt 41 by the secondary transfer roller 51 and the secondary transfer opposite roller 46 at a predetermined pressure. Precision of the parallel position of the secondary transfer roller 51 to the secondary transfer opposite roller 46 is controlled by a positioning member, not shown, provided in the intermediate transfer device 40. A positioning roller (not shown) provided in the secondary transfer roller 51 stabilizes the contact pressure of the secondary transfer roller 51 on the intermediate transfer belt 41. When the secondary transfer roller 51 contacts the intermediate transfer belt 41, a transfer bias of a polarity opposite to that of toner is applied to the secondary transfer roller 51, so that toner images superposed on the intermediate transfer belt 41 are transferred to the transfer sheet 90 at once.

When the image forming operation starts, the transfer sheet 90 is conveyed by paper feeding rollers 81*a*, 81*b*, and 81*c* from a transfer paper cassette 80 or a manual feed tray 83, and is pressed against a nip between a pair of registration rollers 82. When the leading edge of the superposed toner image on the intermediate transfer belt 41 reaches the secondary transfer roller 51, the pair of registration rollers 82 is rotated such that the leading edge of the transfer sheet 90 is aligned with the leading edge of the toner images. The toner images on the intermediate transfer belt 41 contact the transfer sheet 90 as the transfer sheet 90 passes a secondary transfer position. The transfer sheet 90 is charged by the transfer bias of the secondary transfer roller 51, so that the toner images are transferred onto the transfer sheet 90. The transfer sheet 90 is conveyed to the fixing device 60, and the toner images are melt-fixed onto the transfer sheet 90 at a nip between a fixing belt 61 and a pressurizing roller 62. The transfer sheet 90 is sent out of the image forming apparatus 1 in a direction indicated by an arrow C, and stacked face-down on a paper discharge tray 84. The operation of producing a full-color image is thus completed.

Duplex printing is performed as follows. After passing through the fixing device 60, a duplex changeover claw 65 guides the transfer sheet 90 to the paper reversing device 70. In the paper reversing device 70, a reverse changeover claw 71 guides the transfer sheet 90 in a direction indicated by an arrow D. As the trailing edge of the transfer sheet 90 passes the reverse changeover claw 71, a pair of reverse rollers 72 stops rotating, and the transfer sheet 90 stops. After a predetermined time, the pair of reverse rollers 72 rotates in a reverse direction, so that the transfer sheet 90 switches back. This time, the reverse changeover claw 71 is switched to guide the transfer sheet 90 in a direction indicated by an arrow E, to the pair of registration rollers 82. The transfer sheet 90 is pressed against the nip between the pair of registration rollers 82, and stops for a predetermined time. The pair of registration rollers 82 rotates to send the transfer sheet 90 to the secondary transfer position, superposed toner images on the intermediate transfer belt 41 are transferred onto the transfer sheet 90, the toner images are melt-fixed onto the transfer sheet 90 at the fixing device 60, and the transfer sheet 90 is sent out of the image forming apparatus 1.

After primary transfer, the surface of the photoconductive belt 11 is cleaned by the photoconductor cleaning device 12, and can be uniformly discharged by a discharging lamp etc. to facilitate the cleaning operation. After toner images are transferred to the transfer sheet 90, the surface of the intermediate transfer belt 41 is cleaned by pressing the cleaning brush 42*a* against the intermediate transfer belt 41. The toner cleaned off from the intermediate transfer belt 41 is accumulated in a toner waste tank 49.

The developing device 30 includes the developing unit 31 (see FIG. 1A) including the developing sleeve 31*a* that rotates and carries toner on the surface thereof for developing an electrostatic latent image on the photoconductive belt 11, and the first conveying paddle 31*d* (see FIG. 1A) that rotates to scoop and stir toner, and the toner cartridge 32 configured to store toner. The developing device 30 is divided into two units because the developing unit 31 has the durability to last while the toner cartridge 32 is replaced many times.

Figure 7:
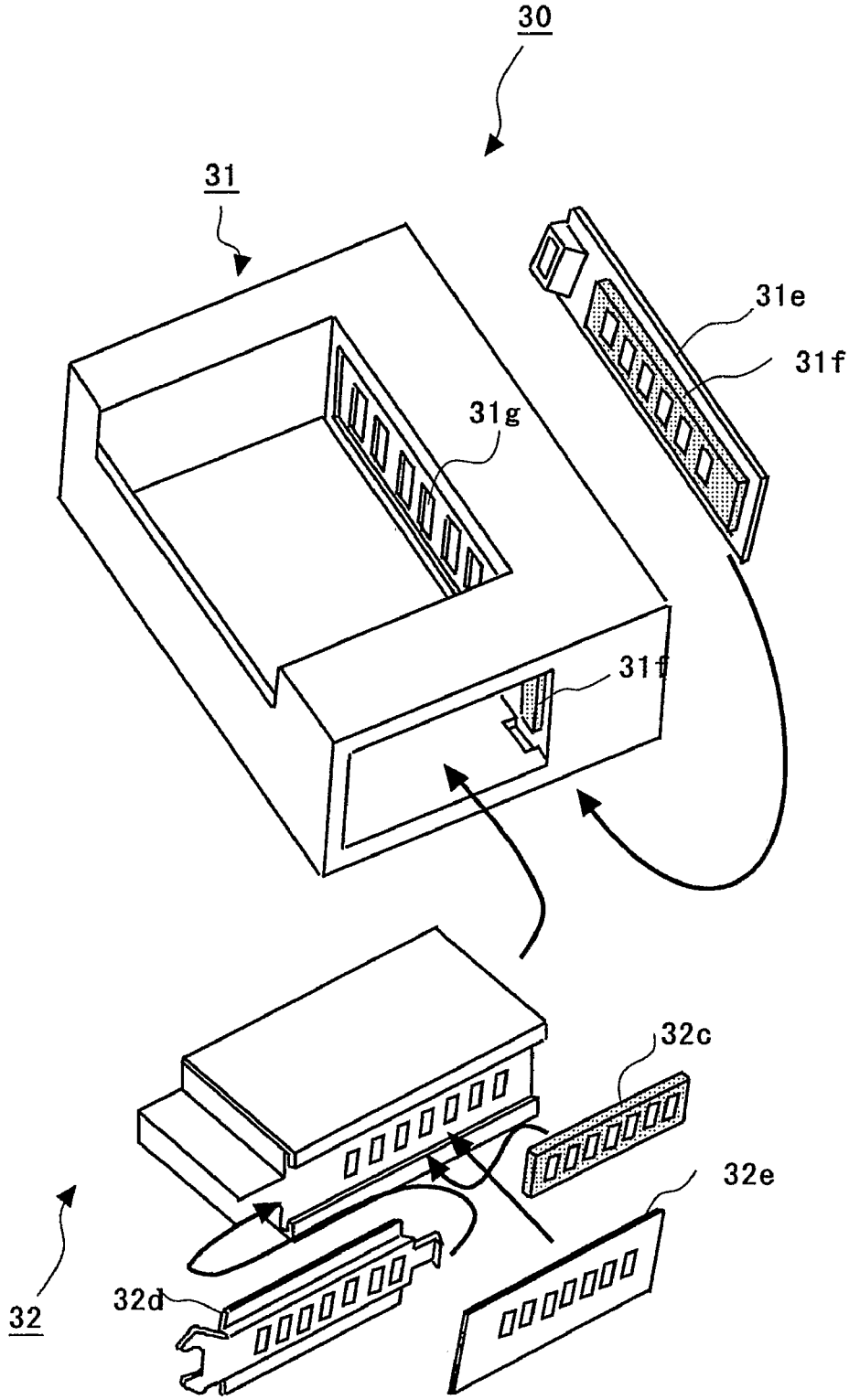
FIG. 7 is a detailed schematic of a communicating opening in the developing device according to the first embodiment.

FIG. 7 is a detailed schematic of the communicating opening 33. A slide shutter 31*e* is provided on the outside of the casing of the developing unit 31, and an elastic member 31*f* adheres to the slide shutter 31*e*. By opening and closing the slide shutter 31*e*, the communicating opening 33 of the developing unit 31 is opened and closed. The toner cartridge 32 is provided with an elastic member 32*c* that has openings corresponding to the communicating opening 33, a slide shutter 32*d* that prevents toner from spilling from the communicating opening 33 when closed and allows toner to pass through when open, and a fixing seal 32*e* that fixes the elastic member 32*c* and the slide shutter 32*d* to the casing of the toner cartridge 32. The elastic member 32*c* is preferably made of foamed material such as urethane resin and silicon resin.

When the toner cartridge 32 is arranged in the developing device 30, and the slide shutter 31*e* and the slide shutter 32*d* are open, the communicating opening 33 is open to let toner pass through.

When the toner cartridge 32 is not arranged in the developing device 30 or the image forming apparatus 1, the slide shutter 31*e* is closed so that toner is prevented from spilling out of the developing unit 31 through the communicating opening 33.

When the developing unit 31 is not arranged in the developing device 30 or the image forming apparatus 1, the slide shutter 32*d* is closed so that toner is prevented from spilling out of the toner cartridge 32 through the communicating opening 33.

Windows 31*g* are provided on the slide shutter 31*e*. The windows 31*g* match the communicating opening 33. When the communicating opening 33 is closed, the communicating opening 33 is blocked by the slide shutter 31*e* where there are no windows 31*g*. When the communicating opening 33 is open, the slide shutter 31*e* is slid so that the windows 31*g* match with the communicating opening 33.

In the developing device 30, the first conveying paddle 31*d* stirs toner and conveys the toner to the supplying roller 31*b*, the supplying roller 31*b* is rubbed against the developing sleeve 31*a*, so that the toner charged by friction-charging. The charged toner is adheres to the developing sleeve 31*a* by image force, and is conveyed on the developing sleeve 31*a*. The restricting roller 31*c* restricts the amount of toner conveyed by the developing sleeve 31*a* to the developing area. A thin toner layer formed on the developing sleeve 31*a* is developed onto the photoconductive belt 11 by a developing bias in the developing area.

When the toner on the supplying roller 31*b* is rubbed by the developing sleeve 31*a*, the toner receives large pressure so that asperities on the surface of toner particles are crushed, which increases adherence of the toner. The large pressure pushes outer additives on the surface of toner particles inside. As a result, flowability of the toner decreases, and a charging amount of the toner decreases, because the charging amount cannot be adjusted by the outer additives. Thus, developing properties, transferring properties, and cleaning properties of the toner deteriorate.

When toner is consumed, the percentage of deteriorated toner increases in the developing unit 31. Therefore, fresh toner is supplied into the developing unit 31 from the toner cartridge 32 through the communicating opening 33. The second conveying paddle 32*a* and the third conveying paddle 32*b* provided in the first storage space 321 and the second storage space 322, respectively, rotate in contact with the inner walls of the toner cartridge 32. By rotation of the second conveying paddle 32*a* and the third conveying paddle 32*b*, the toner is pushed into the developing unit 31 through the communicating opening 33.

Toner in the developing unit 31 is discharged to the toner cartridge 32 through the communicating opening 33, and the toner is mixed with toner in the toner cartridge 32. The toner cartridge 32 stores a large amount of unused toner, which is mixed with the deteriorated toner from the developing unit 31. Accordingly, outer additives adhering on surfaces of the unused toner particles are distributed to the deteriorated toner, so that chargeability and flowability of the deteriorated toner becomes close to that of the unused toner. The toner discharged from the developing unit 31 to the first storage space 321 is conveyed to the second storage space 322 by the second conveying paddle 32*a*, and then returned to the first storage space 321 by the third conveying paddle 32*b*. During this operation, the outer additives are distributed to the deteriorated toner.

The toner that is brought back to an unused state is returned to the developing unit 31 from the first storage space 321. The toner brought back to an unused state and unused toner in the developing unit 31 form a thin layer on the developing sleeve 31*a* for developing a toner image. Accordingly, high quality images can be obtained over a long time.

In the developing device 30 according to the first embodiment, the control valve 34 is provided in the toner cartridge 32 for blocking the communicating opening 33, so that the developing unit 31 discharges toner to the toner cartridge 32, the toner is mixed with toner in the toner cartridge 32, and the toner is supplied once again to the developing unit 31. In a developing device 300 according to a second embodiment of the present invention, a control valve 340 is provided in the developing unit 31 at the communicating opening 33, so that the developing unit 31 discharges toner to the toner cartridge 32, the toner is mixed with toner in the toner cartridge 32, and the toner is supplied once again to the developing unit 31. Toner can be steadily supplied to and discharged from the developing device 300. Moreover, the developing device 300 includes a first conveying paddle 310*d* that uniformly stirs toner in the developing unit 31.

Figure 8:
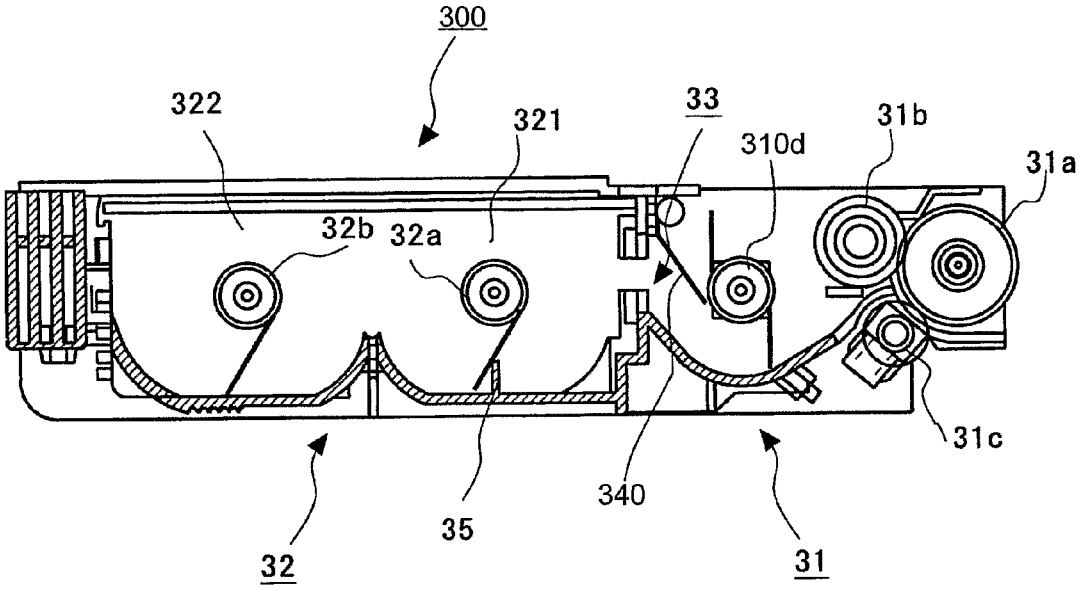
FIG. 8 is a schematic of a developing device according to a second embodiment of the present invention.

FIG. 8 is a schematic of the developing device 300.

The components in the second embodiment that perform same or similar function or that have same or similar configuration as those in the first embodiment are denoted by the same reference numerals as the first embodiment, and overlapping descriptions are omitted. The developing device 300 includes the developing unit 31 and the toner cartridge 32. The developing unit 31 includes the developing sleeve 31*a*, the supplying roller 31*b*, the restricting roller 31*c*, and the first conveying paddle 310*d*. The toner cartridge 32 includes the first storage space 321, the second storage space 322, the second conveying paddle 32*a*, the third conveying paddle 32*b*, and the rib 35. Toner passes through the communicating opening 33 between the developing unit 31 and the toner cartridge 32. The control valve 340 is provided in the developing unit 31 at the communicating opening 33.

The control valve 340 has a similar structure to that of the control valve 34 according to the first embodiment, and is therefore described with reference to FIG. 2. The control valve 340 is provided corresponding to the communicating opening 33, and is pasted to the support unit 34*a* fixed in the casing of the toner cartridge 32. The control valve 340 includes rectangular plates, which are the elastic resin films 34*b*, provided alternately corresponding to the communicating opening 33, so that a plate is not provided where there is no opening. The support unit 34*a* is made of a rigid metal such as SUS, Cu, and Al. The elastic resin films 34*b* are made of polypropylene, polyethylene, polyester resin, fluorine resin, etc.

The first conveying paddle 310*d* has a paddling film that rotates and conveys toner supplied from the toner cartridge 32 to the developing sleeve 31*a*. The paddling film of the first conveying paddle 310*d* can be single or plural. Specifically, the paddling film can be a single, long film, or a plurality of rectangular films that contact the rectangular films of the control valve 340 arranged in a comb-like form. A combination a long film and rectangular films can be employed as the paddling film of the first conveying paddle 310*d*.

Figure 9:
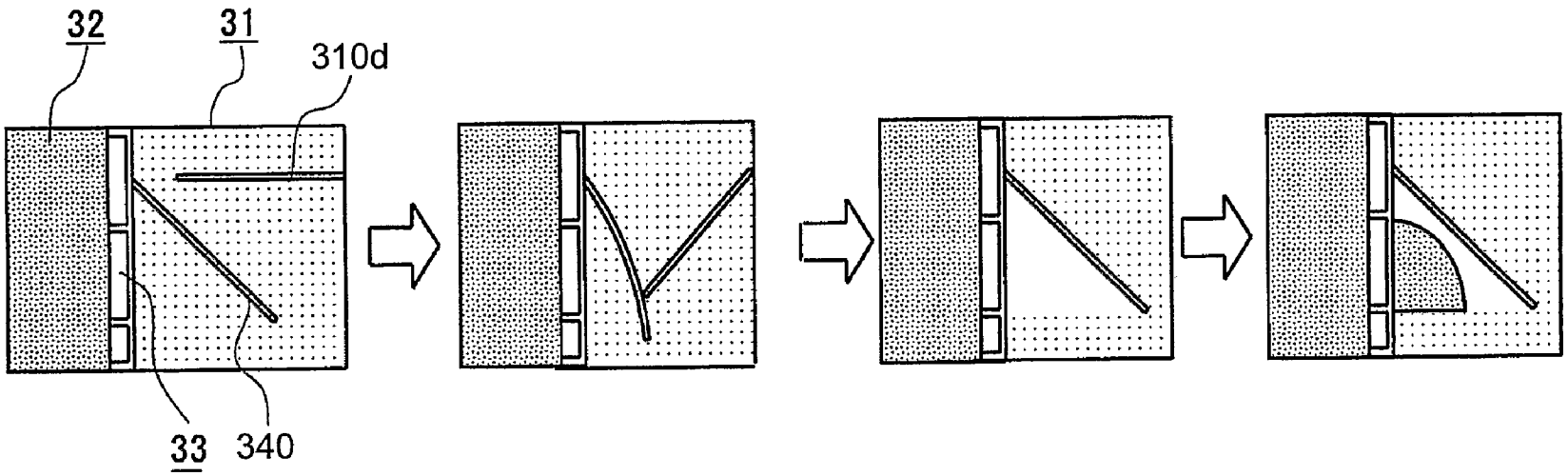
FIG. 9 is a diagram for explaining an operation of supplying toner from a toner cartridge to a developing unit in the developing device according to the second embodiment.

FIG. 9 is a diagram for explaining the operation of supplying toner from the toner cartridge 32 to the developing unit 31 in the developing device 300. The first conveying paddle 310*d* rotates and contacts the control valve 340, and holds down the control valve 340. When the first conveying paddle 310*d* passes by and releases the control valve 340, the control valve 340 quickly flips back open by its own elasticity, so that toner pushed towards the developing unit 31 from the toner cartridge 32 is drawn into the developing unit 31 through the communicating opening 33.

Figure 10:
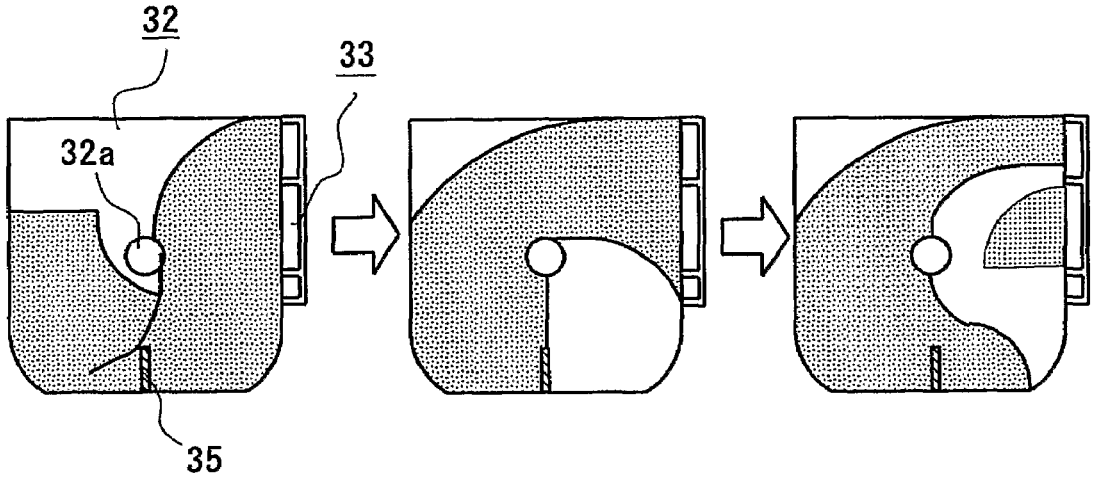
FIG. 10 is a diagram for explaining movement of toner between the toner cartridge and the developing unit in the developing device according to the second embodiment.

FIG. 10 is a diagram for explaining movement of toner between the toner cartridge 32 and the developing unit 31 in the developing device 300. In the toner cartridge 32, toner in the second storage space 322 is conveyed to the first storage space 321 by the third conveying paddle 32*b*, and is then conveyed to the developing unit 31 by the second conveying paddle 32*a*. The second conveying paddle 32*a* includes a single paddling film, which is rotated to convey toner to the developing unit 31. The first storage space 321 includes the rib 35, so that toner is stopped at the rib 35, and a space is formed between the rib 35 and the paddling film. Although the space is gradually filled with toner having high flowability, the space is maintained for a predetermined time. When the paddling film is further rotated, toner moves into the space from above, until the space is filled up.

Accordingly, when toner is pushed into the developing unit 31 at a time coinciding with when the control valve 340 is not held down by the paddling film of the first conveying paddle 310*d*, i.e., when the control valve 340 is in an open state, toner moves from the toner cartridge 32 to the developing unit 31.

The toner enters the developing unit 31 towards the control valve 340. Subsequently, when the toner is pushed from the developing unit 31 to the toner cartridge 32 by rotation of the paddling film of the first conveying paddle 310*d* at a time coinciding with when a space formed by the second conveying paddle 32*a* reaches the communicating opening 33, the toner is discharged from the developing unit 31 to the toner cartridge 32.

Figure 11A:
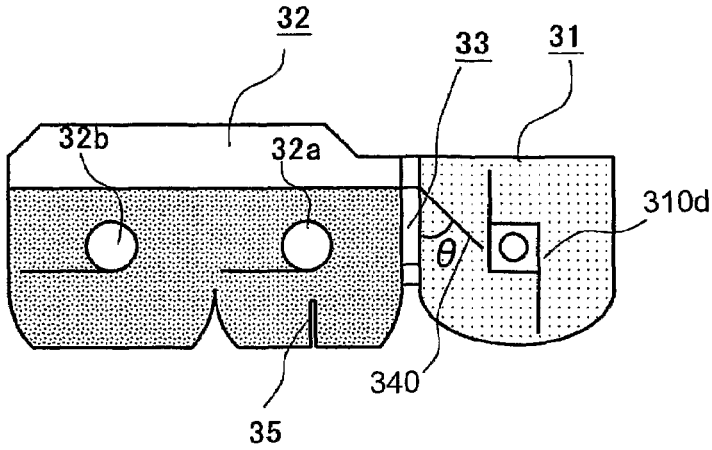
FIGS. 11A to 11P are detailed schematics for explaining movement of toner between the developing unit and the toner cartridge in the developing device according to the second embodiment.
Figure 11B:
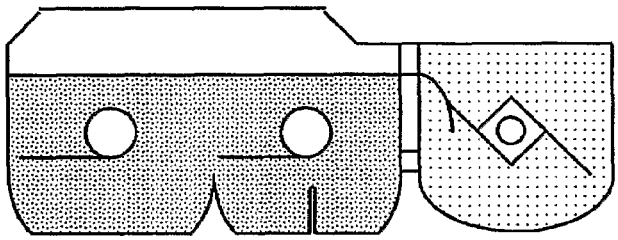
Figure 11C:
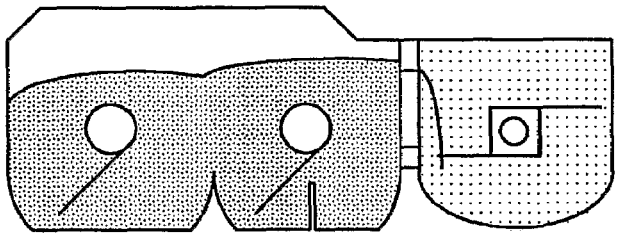
Figure 11D:
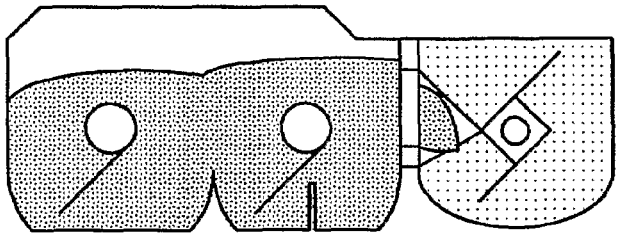
Figure 11E:
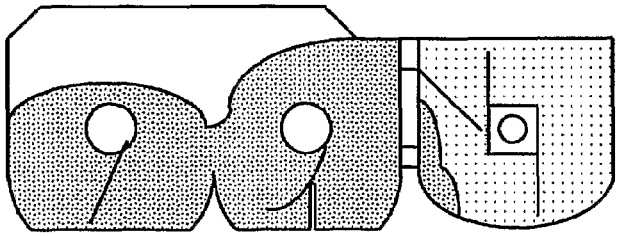
Figure 11F:
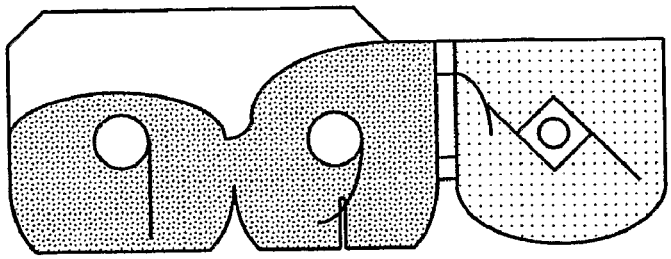
Figure 11G:
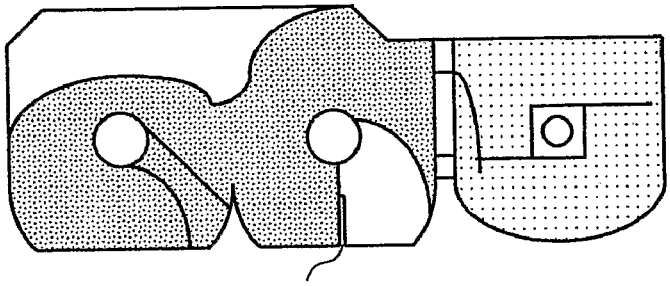
Figure 11H:
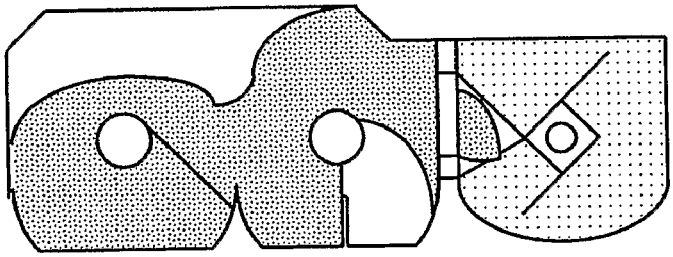
Figure 11I:
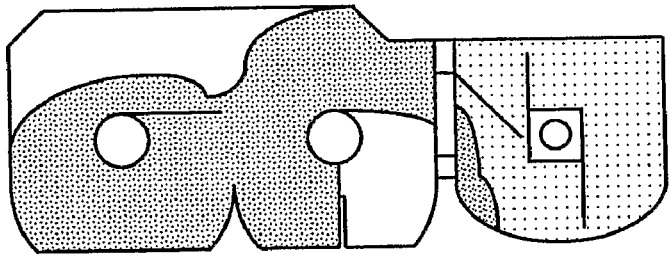
Figure 11J:
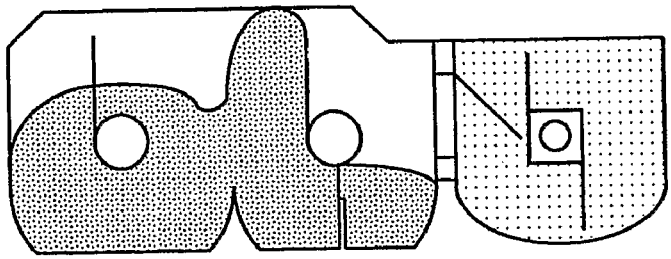
Figure 11K:
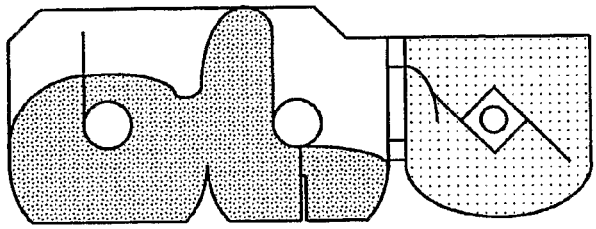
Figure 11L:
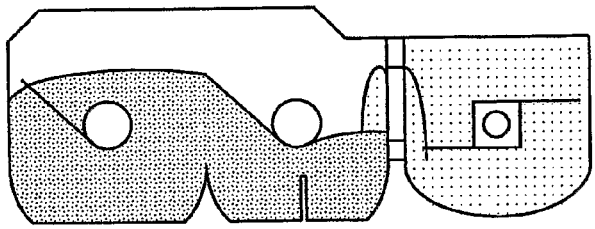
Figure 11M:
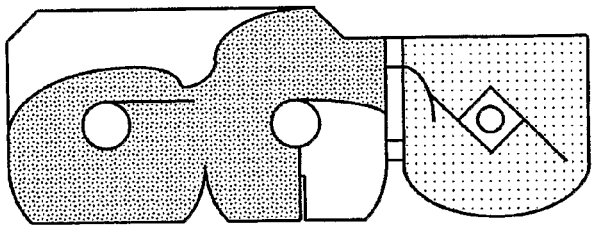
Figure 11N:
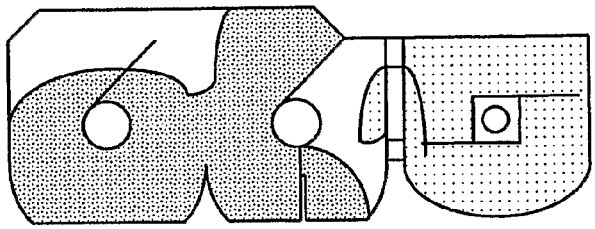
Figure 11O:
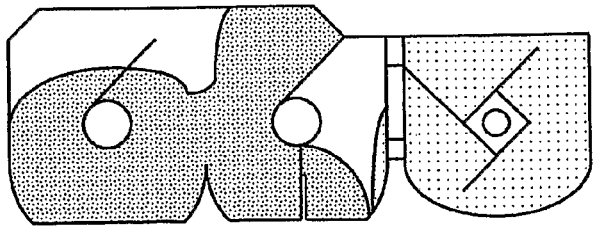
Figure 11P:
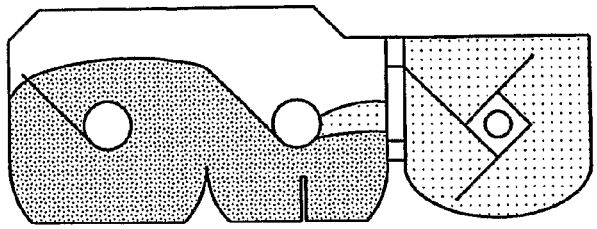

FIGS. 11A to 11P are detailed schematics for explaining movement of toner between the developing unit 31 and the toner cartridge 32. The developing sleeve 31*a* etc. in the developing unit 31 are omitted herein.

In FIG. 11A, the control valve 340 is arranged at an angle θ with respect to an inner wall of the developing unit 31. The first conveying paddle 310*d* includes a plurality of paddling films, which are rotated. The second conveying paddle 32*a* and the third conveying paddle 32*b* each includes a single paddling film. As shown in FIG. 11B, the first conveying paddle 310*d* rotates the plurality of paddling films that holds down the control valve 340. If the control valve 340 is pressed to block the communicating opening 33 when toner in the toner cartridge 32 is contacting the communicating opening 33, toner between the control valve 340 and the communicating opening 33 cannot enter the communicating opening 33. Therefore, the toner in the developing unit 31 is pushed out from the sides of the control valve 340, returning into the developing unit 31. As shown in FIG. 11C, the paddling films of the first conveying paddle 310*d* further presses the control valve 340, so that there is substantially no space between the control valve 340 and the communicating opening 33. As shown in FIG. 11D and FIG. 11E, as each paddling film moves away from the control valve 340, the control valve 340 returns to the position at the angle θ. A this position, a large space is formed between the control valve 340 and the communicating opening 33, so that toner moves from the toner cartridge 32 to the developing unit 31 through the communicating opening 33.

As shown in FIG. 11F, the control valve 340 is pressed once again by another paddling film of the first conveying paddle 310*d*. At this time point, the paddling film of the second conveying paddle 32*a* is contacting the rib 35 in the second storage space 322 of the toner cartridge 32. As shown in FIG. 11G, as the paddling film of the first conveying paddle 310*d* is further rotated, the control valve 340 is further pressed down, so that there is no space between the control valve 340 and the communicating opening 33. At this time point, the paddling film of the second conveying paddle 32*a* rotates past the rib 35, and toner is blocked by the rib 35, so that a space is formed in the toner of the toner cartridge 32. As shown in FIG. 11H and FIG. 11I, the paddling film of the first conveying paddle 310*d* releases the control valve 340, so that the control valve 340 returns to the angle θ, thereby forming a large space between the control valve 340 and the communicating opening 33. Thus, toner that is lifted up by the paddling film of the second conveying paddle 32*a* moves from the toner cartridge 32 into the developing unit 31 through the communicating opening 33.

The control valve 340 is pressed yet once again by the other paddling film of the first conveying paddle 310*d*. At the previous time the control valve 340 was pressed down, there was toner in the toner cartridge 32 near the communicating opening 33. Therefore, the toner in the developing unit 31 was pushed out from the sides of the control valve 340, returning into the developing unit 31. This time, however, because there is a space in the toner cartridge 32 near the communicating opening 33, the toner is discharged from the developing unit 31 into the toner cartridge 32 through the communicating opening 33 as the paddling film of the first conveying paddle 310*d* presses the control valve 340, as shown in FIGS. 11J to 11L.

By rotating the first conveying paddle 310*d* at a higher speed than the second conveying paddle 32*a*, toner is discharged from the developing unit 31 to the toner cartridge 32, as shown in FIGS. 11M to 11P.

These operations are repeated so that toner moves between the developing unit 31 and the toner cartridge 32 through the communicating opening 33.

Rotational frequencies of the first conveying paddle 310*d* in the developing unit 31 and the second conveying paddle 32*a* in the toner cartridge 32 can be controlled to adjust the amount of toner moving between the developing unit 31 and the toner cartridge 32. For example, by rotating the first conveying paddle 310*d* in the developing unit 31 at a higher rotational frequency than the second conveying paddle 32*a* in the toner cartridge 32, the number of times that a space formed in the toner cartridge 32 contacts the communicating opening 33 is decreased, while the number of times that the first conveying paddle 310*d* presses the control valve 340 is increased. Accordingly, the number of times that toner is supplied into the developing unit 31 is increased.

The amount of toner moving between the developing unit 31 and the toner cartridge 32 can be adjusted by the number of the communicating openings 33. More than one communicating opening 33 can provided. The number of communicating openings 33 is determined based on the speed of the image forming operation.

The control valve 340 provided corresponding to the communicating opening 33 can be a comb-like form, including a plurality of valves. The control valves 340 adjacent to each other can be operated alternately. Specifically, each of the two paddling films of the first conveying paddle 310*d* can be a comb-like form with films provided alternately, so that half of the control valves 340 are pressed by one paddling film, and the other half of the control valves 340 are pressed by the other paddling film. Accordingly, toner in the developing unit 31 can be evenly discharged, without leaving a dead space.

Figure 12:
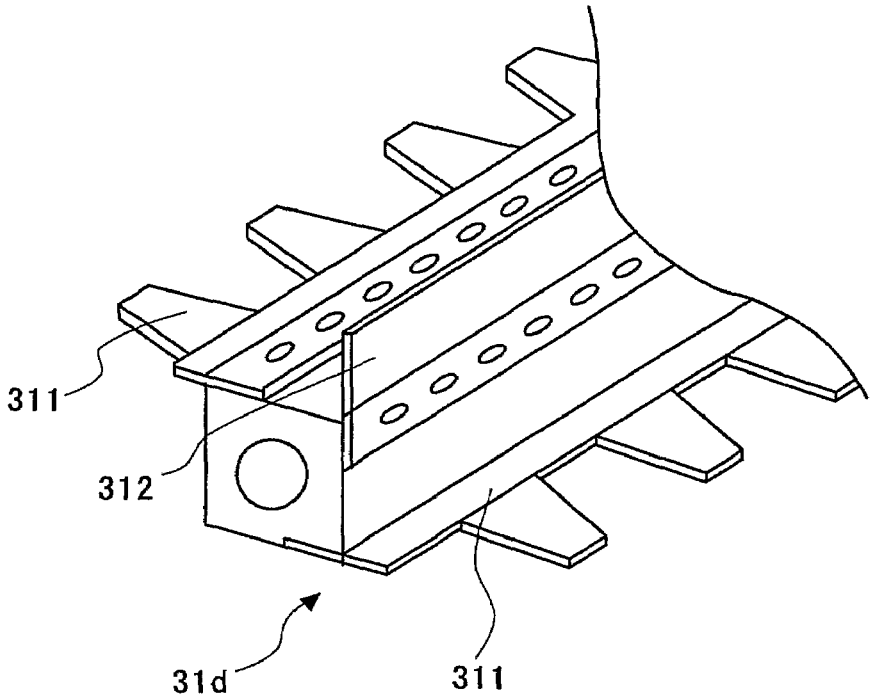
FIG. 12 is a perspective view of a first conveying paddle according to the second embodiment.

FIG. 12 is a perspective view of the first conveying paddle 310*d*.

Films 311 and a rectangular film 312 are attached to a quadrangle axis. The films 311 include two films, each extending in opposite directions from opposite surfaces. The films 311 are in a comb-like form with alternate concavities and convexities, and the convexities of the two films 311 are shifted from each other. Thus, adjacent control valves 340 are alternately pressed by the two films 311. The convexities are provided corresponding to the communicating opening 33, and are long enough to press down the control valve 340. The concavities are arranged so as not to contact the control valve 340.

Each convexity is tapered so that the base of the convexity is wider than the tip. Accordingly, the convexities also move toner in a longitudinal direction of the developing unit 31 as the first conveying paddle 310*d* rotates, so that the toner is stirred in the longitudinal direction.

As the first conveying paddle 310*d* rotates, the convexities press the control valve 340, so that toner under the control valve 340 moves into the toner cartridge 32.

The first conveying paddle 310*d* is rotated at a higher speed than the second conveying paddle 32*a*, so that the first conveying paddle 310*d* presses the control valve 340 several times while a space is formed in the toner cartridge 32, thereby efficiently conveying toner to the toner cartridge 32.

When the convexities of the films 311 pass by the control valve 340, the control valve 340 is released from suppress strength, and flips back open by elasticity. Accordingly, toner on the control valve 340 is returned into the developing unit 31, and a space for letting toner in from the toner cartridge 32 is formed under the control valve 340.

The convexities of the two films 311 are shifted from each other, so that the control valves 340 adjacent to each other are alternately pressed and released. Accordingly, toner is efficiently circulated between the developing unit 31 and the toner cartridge 32.

The first conveying paddle 310*d* includes the two comb-like films 311, and therefore, toner is efficiently circulated, and mixed in the longitudinal direction. However, with only the two comb-like films 311, toner accumulates near the communicating opening 33 in the developing unit 31. As a result, the toner surface in the developing unit 31 ripples in a vertical direction, forming mountain parts and valley parts. If a mountain part is formed at the communicating opening 33, toner from the toner cartridge 32 is inhibited from moving in, and the amount of toner supply in the developing unit 31 decreases. Moreover, a toner flow from the toner cartridge 32 is created at the foot of the mountain part. As a result, the toner is somewhat inhibited from being evenly stirred. To improve these problems, the rectangular film 312 that has no convexities or concavities, which is shorter than the convexity of the films 311, is provided between the two films 311 at an angle of 90 degrees with respect to the films 311. Accordingly, the mountain part of the toner is eliminated, so that the surface of toner in the developing unit 31 is substantially flat.

The rectangular film 312 is provided between the two films 311 to steadily move toner between the developing unit 31 and the toner cartridge 32, so that the toner is sufficiently circulated. The rectangular film 312 also prevents a toner flow from being created at a local position, so that the toner is evenly stirred in the developing unit 31.

Figure 13:
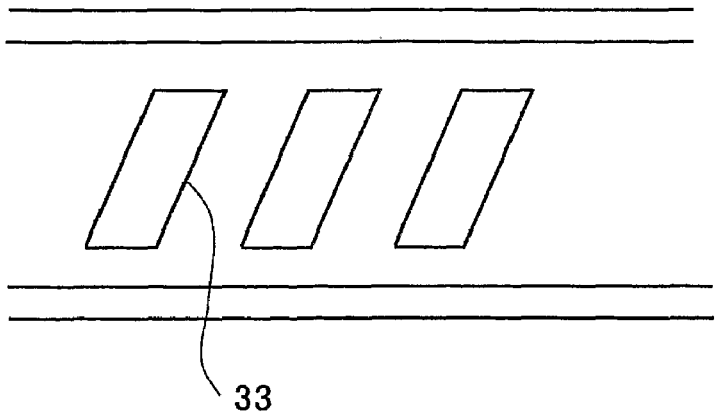
FIG. 13 is a schematic of a communicating opening in the developing device according to the second embodiment.

FIG. 13 is a schematic of the communicating opening 33 in the developing device 300. Each of the communicating openings 33 is diamond-shaped in the second embodiment; however, the communicating opening 33 can be rectangular, oval, etc. A diamond shape is more advantageous than a rectangle, because the width of each of the communicating openings 33 is wider, and toner can be spread further in a longitudinal direction. Thus, with diamond-shaped communicating openings 33, toner can be circulated more efficiently between the toner cartridge 32 and the developing unit 31, and the number of films configuring the control valve 340 can be reduced.

The width of the control valve 340 is equal to or wider than the width of the communicating opening 33 by less than 20 millimeters. If the control valve 340 is narrower than the communicating opening 33, toner in the developing unit 31 blocks the communicating opening 33, thereby inhibiting toner supply from the toner cartridge 32. Toner in between the control valve 340 and the communicating opening 33 is discharged from the developing unit 31 to the toner cartridge 32, so that a large amount of toner is not discharged at once. However, if the control valve 340 is narrower than the communicating opening 33, a large amount of toner is discharged, and the amount of toner in the developing unit 31 becomes insufficient.

On the other hand, if the control valve 340 is excessively wider than the communicating opening 33, the amount of toner that enters from the sides of the control valve 340 in between the control valve 340 and the communicating opening 33 is reduced. Accordingly, the amount of toner discharged from the developing unit 31 to the toner cartridge 32 is reduced, so that deteriorated toner is not sufficiently replaced with fresh toner. The toner supplied from the toner cartridge 32 moves to the bottom of the communicating opening 33, and is mixed with toner at the bottom of the control valve 340. Thus, if the control valve 340 is excessively wide, the amount of toner supplied is reduced, and therefore, the toner is not mixed sufficiently evenly.

The width of the control valve 340 is preferably equal to or wider by less than 20 millimeters than the width of the communicating opening 33. Accordingly, the amount of toner supplied and discharged is controlled, and toner supplied in the developing unit 31 is mixed evenly.

Intervals between the control valves 340 are 2 millimeters to 20 millimeters. If the intervals are less than 2 millimeters, the amount of toner that enters in between the control valve 340 and the communicating opening 33 decreases, so that the amount of toner discharged from the developing unit 31 decreases. If the intervals exceed 20 millimeters, the number of communicating openings 33 decreases, so that the amount of toner discharged from and supplied to the developing unit 31 decreases.

The length of the control valve 340 is 10 millimeters to 25 millimeters. The length of the control valve 340 determines the size of the space formed between the control valve 340 and the communicating opening 33. Thus, if the length of the control valve 340 is less than 10 millimeters, the amount of toner discharged from the developing unit 31 decreases, so that deteriorated toner is not sufficiently replaced with fresh toner. If the length of the control valve 340 exceeds 25 millimeters, the amount of toner discharged from the developing unit 31 increases, so that the amount of toner in the toner hopper in the developing unit 31 is insufficient.

The angle of the control valve 340 is 20 degrees to 45 degrees when open, and 0 degrees to 15 degrees when closed, against the communicating opening 33. The control valve 340 bends because it is elastic. Therefore, the angle of the control valve 340 is defined assuming that a line connecting the point where the control valve 340 contacts the wall of the developing unit 31 and the tip of the control valve 340 is straight. The angle of the control valve 340 determines the size of the space formed between the control valve 340 and the communicating opening 33. Thus, if the angle of the control valve 340 is less than 20 degrees when open, the amount of toner discharged from the developing unit 31 decreases, so that replacement of deteriorated toner with fresh toner is not performed sufficiently. If the angle of the control valve 340 exceeds 45 degrees when open, an excessive amount of toner is discharged from the developing unit 31, so that the amount of toner in the toner hopper of the developing unit 31 is insufficient.

The developing device 300 can be used in the same image forming apparatus as described in the first embodiment with reference to FIG. 6, and therefore, overlapping explanations are omitted. Details of the communicating opening 33 are the same as described in the first embodiment with reference to FIG. 7, and therefore, overlapping explanations are omitted.

The developing device according to the first and the second embodiments can be integrated with at least a photoconductor, and employed in a process cartridge that is detachably attached to an image forming apparatus. In the developing device, outer additives are reapplied to deteriorated toner so that high-quality images can be obtained over a long time.

The developing device 300 according to the second embodiment is compared with a conventional developing device. The conventional developing device is configured in such a manner that the control valve 340 and the rib 35 from the developing unit 30K, and the films 311 and 312 of the first conveying paddle 310*d* is replaced by a single paddling film, similarly as the second conveying paddle 32*a*. With this configuration, in the conventional developing device, the toner passing through the communicating opening 33 flows in substantially one way from the toner cartridge 32 to the developing unit 31, and unlike in the developing device 300 according to the second embodiment, is not virtually discharged to the toner cartridge 32 in the developing unit 31 through the communicating opening 33.

Figure 14:
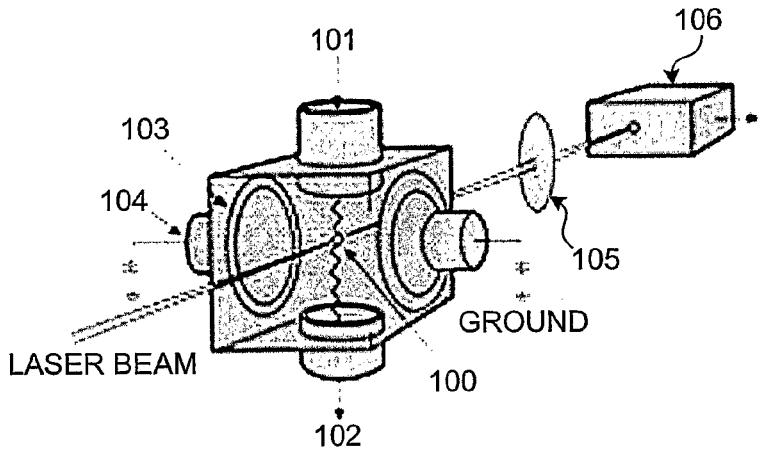
FIG. 14 is a schematic of a toner-charging-amount evaluating apparatus.

A series of experiments have been performed to compare toner charging characteristics between the developing device 300 according to the second embodiment and the conventional developing device. The developing unit 30K is set in the image forming apparatus 1. After outputting 10,000 sheets with an image area ratio of 3%, each of the toner in the developing unit 31 and the toner in the toner cartridge 32 is collected to evaluate a charging amount of the toner. FIG. 14 is a schematic of a toner-charging-amount evaluating apparatus. The evaluation of the toner charging amount was performed using an E-SPART analyzer (evaluating apparatus) manufactured by HOSOKAWA MICRON COORPORATION, shown in FIG. 14.

The E-SPART analyzer can obtain a particle diameter and a charging amount at the same time by measuring a phase lag and a deflection amount of a charged particle that moves in response to a vibration by an acoustic wave and an influence by an electric field, using a laser Doppler method. As shown in FIG. 14, the E-SPART analyzer includes a measurement area 100, a particle input port 101, a particle output port 102, an acoustic vibration plate 103, an electrode 104, a focusing lens 105, and a photo multiplier tube 106.

Figure 15:
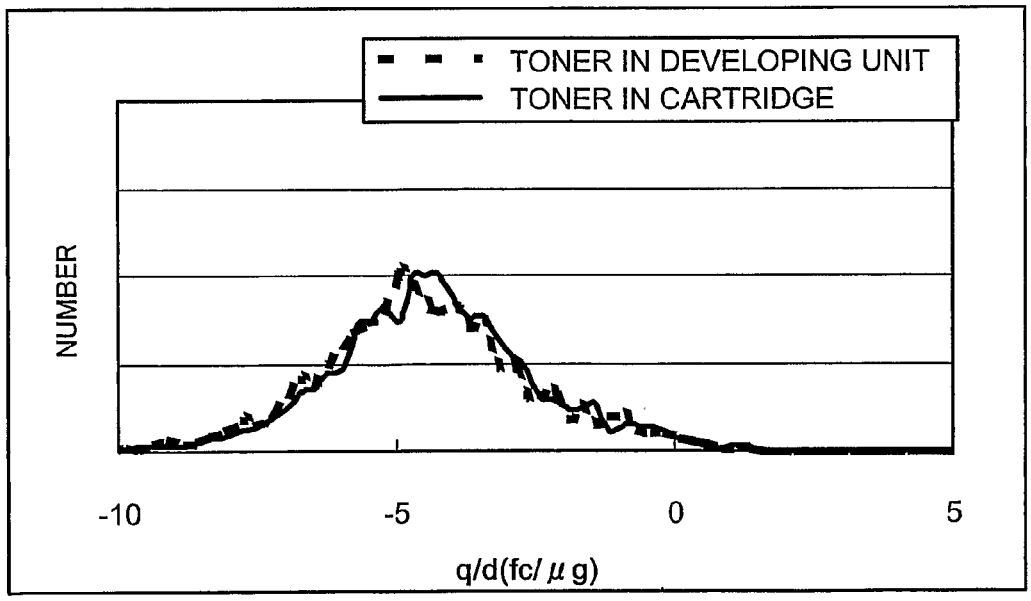
FIG. 15 is a graph of a result of evaluating a toner charging amount according to the second embodiment.
Figure 16:
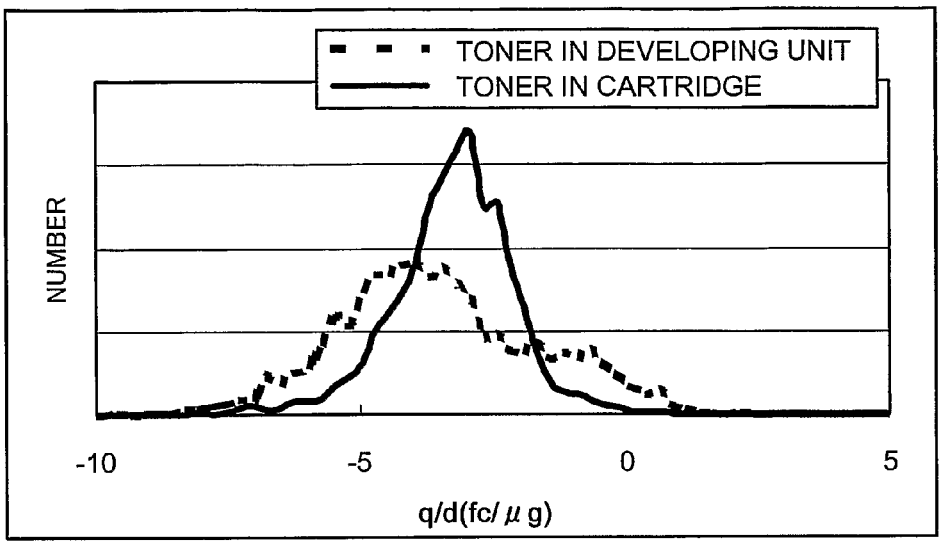
FIG. 16 is a graph of a result of evaluating a toner charging amount according to a conventional technology.

FIG. 15 is a graph of a result of evaluating a toner charging amount according to the second embodiment. FIG. 16 is a graph of a result of evaluating a toner charging amount in the conventional developing device.

As shown in FIG. 16, in the conventional developing device, a peak of the toner charging amount in the developing unit 31 is deviated from a peak of the toner charging amount in the toner cartridge 32. When there are mixed toners having different charging amounts, a background contamination occurs, and when the mixed amount is not even, a density fluctuation occurs in a vertical strip.

On the other hand, as shown in FIG. 15, the peak of the toner charging amount in the developing unit 31 almost matches with the peak of the toner charging amount in the toner cartridge 32 in the developing device 300 according to the second embodiment. In the case of the second embodiment, there is no difference in the charging amounts, and even at a time of outputting 1,000 sheets, a good image with no background contamination or density fluctuation could be obtained. It is because the film presses the control valve 340 by a rotation of the first conveying paddle 310*d*, so that the toner under the control valve 340 returns to the toner cartridge 32, resulting in an enough mixing of the toner in the toner cartridge 32 and the toner in the developing unit 31.

Although the above experiments were performed using the black toner, even for the yellow toner, the magenta toner, and the cyan toner, it was confirmed that the toner in the toner cartridge 32 and the toner in the developing unit 31 were sufficiently mixed.

To evaluate a stability of time-dependent toner charging, following experiment was performed using the developing unit 30K of the developing device 300 according to the second embodiment and the conventional developing device.

The developing unit 30K in a state in which the toners are filled enough in the developing unit 31 and the toner cartridge 32 (a state of a product to be shipped) is set in the image forming apparatus 1, and an image formation was performed until the toner end is displayed with the image area ratio of 2%. After that, the toner cartridge 32 was replaced with a new one, and the image formation was continued.

To evaluate the stability of the time-dependent toner charging for the developing device 300 according to the second embodiment and the conventional developing device, the toner on the developing sleeve 31*a* was collected at (a) the time when the developing unit 30K was set in the image forming apparatus 1, (b) the time when the toner end was displayed, and (c) the time when the toner cartridge 32 was replaced with a new one (however, the evaluation was performed after operating the developing device for about 90 seconds after replacing the toner cartridge, to figure out mixing state of the toner), to evaluate the toner charging amount. The evaluation of the toner charging amount was performed using the E-SPART analyzer manufactured by HOSOKAWA MICRON COORPORATION.

Figure 17:
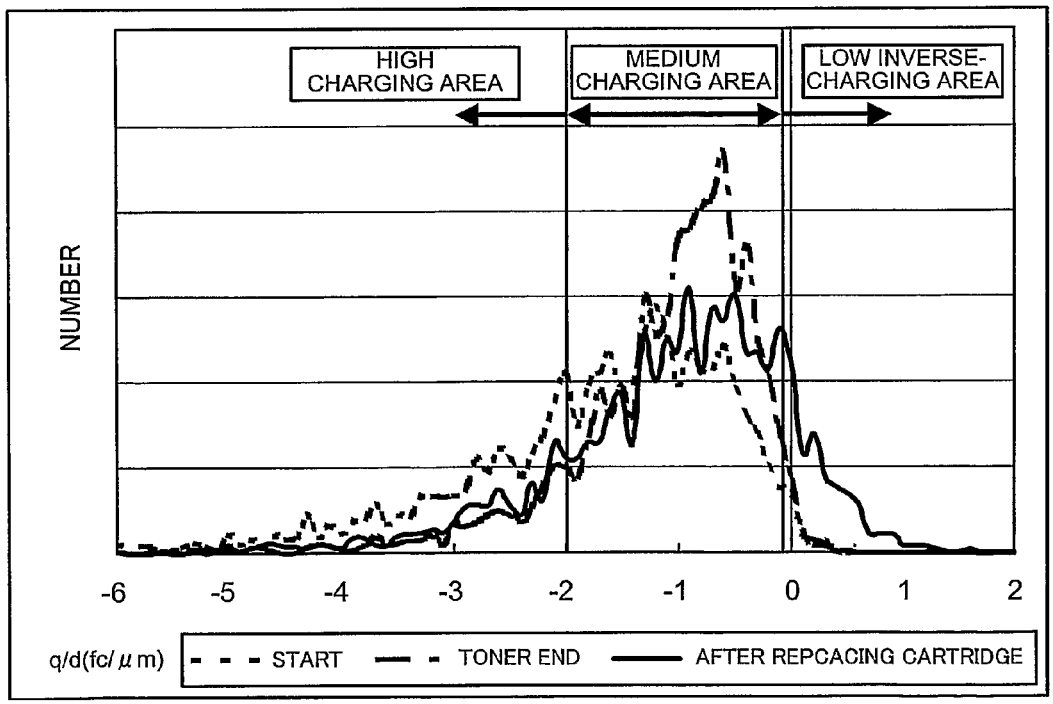
FIG. 17 is another graph of a result of evaluating a toner charging amount according to the second embodiment.
Figure 18:
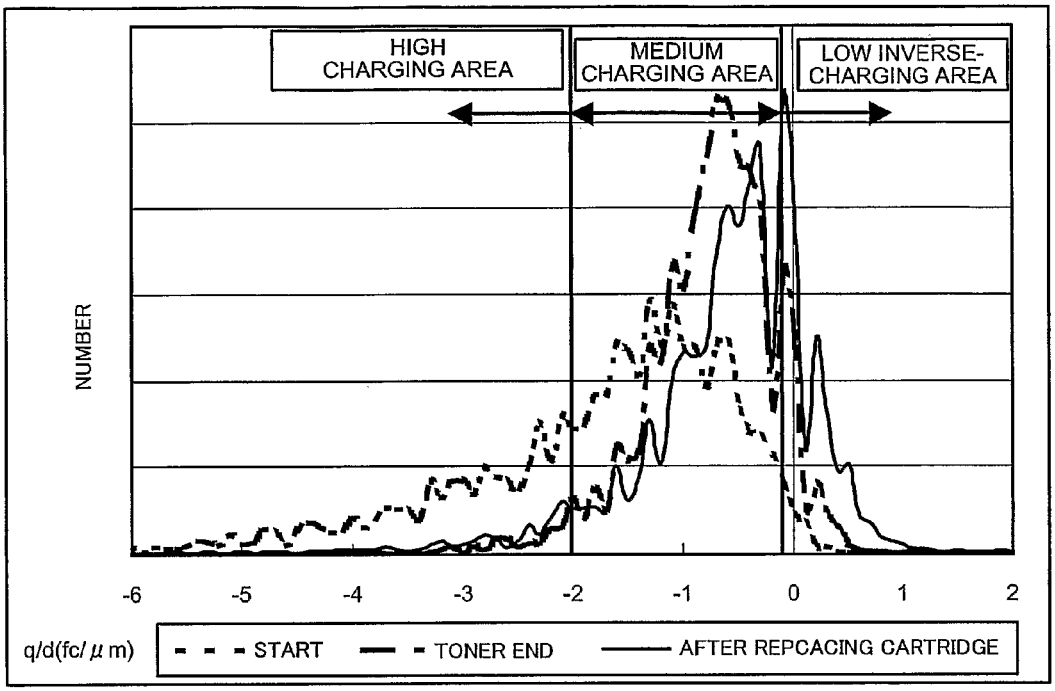
FIG. 18 is another graph of a result of evaluating a toner charging amount according to the conventional technology.

FIG. 17 is a graph of a result of evaluating the toner charging amount of the developing device 300 according to the second embodiment. FIG. 18 is a graph of a result of evaluating the toner charging amount of the conventional developing device.

The peak of the toner charging amount tends to shift to a side of a low inverse-charging area with time in both cases. However, compared with the conventional developing device, an increase of a low inverse-charged toner is suppressed in the developing device 300 according to the second embodiment.

As for the toner charging amount, a high charging area is set to equal to or less than −2 (fc/μm: femto-coulomb/micrometer), the low inverse-charging area is set to equal to or more than −0.2, and an intermediate area between the high charging area and the low inverse-charging area is set to a medium charging area. If a percentage of the toner in the low inverse-charging area increases, the background contamination or the density fluctuation occurs.

Figure 19:
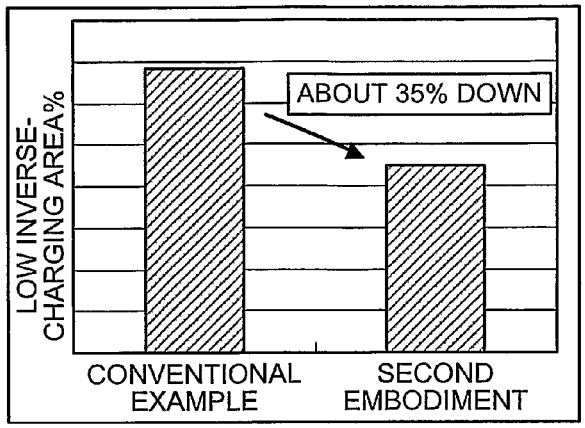
FIG. 19 is a graph of a percentage of a low inverse-charged toner when a toner cartridge is replaced.

FIG. 19 is a graph of a percentage of a low inverse-charged toner when the toner cartridge 32 is replaced. As shown in FIG. 19, compared with the conventional developing device, the developing device 300 according to the second embodiment shows the percentage of the low inverse-charged toner decreased by about 35%, which means that the toner in the toner cartridge 32 and the toner in the developing unit 31 were sufficiently mixed, indicating a good circulation of the toner.

Figure 20:
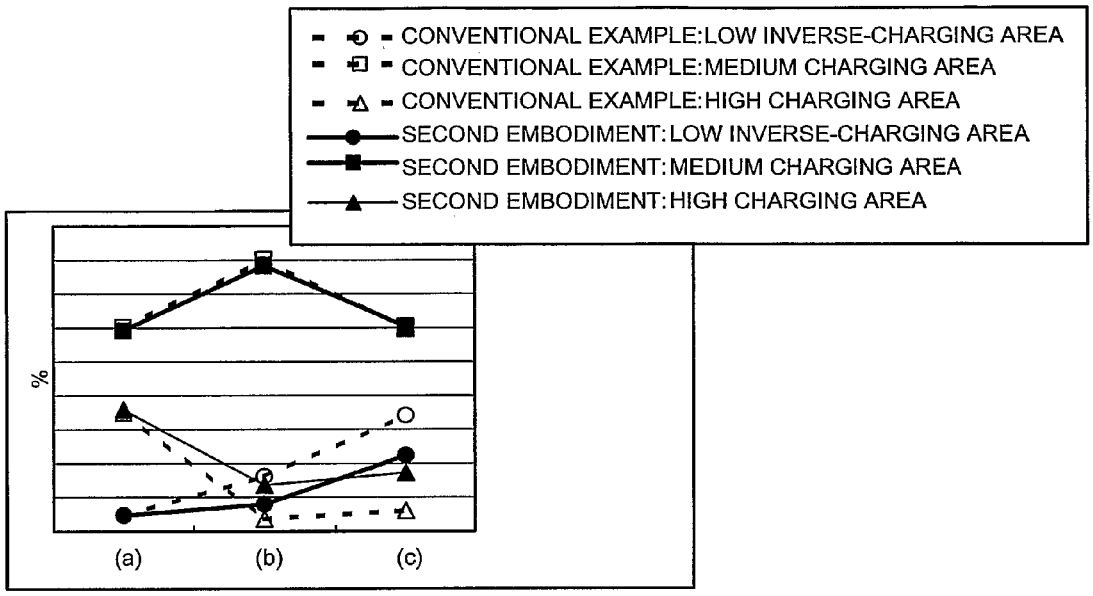
FIG. 20 is a graph for showing a collected toner divided into each charging area.

FIG. 20 is a graph for showing the collected toner at (a) to (c) divided into each of the charging areas. Compared with the conventional developing device, the developing device 300 according to the second embodiment can reduce changes of percentages of the toners in the high charging area and the low inverse-charging area, making it possible to stabilize the toner charging amount on the developing sleeve 31*a* from the time when the developing unit 30K is set to the time when the toner cartridge 32 is replaced with a new one.

Figure 21:
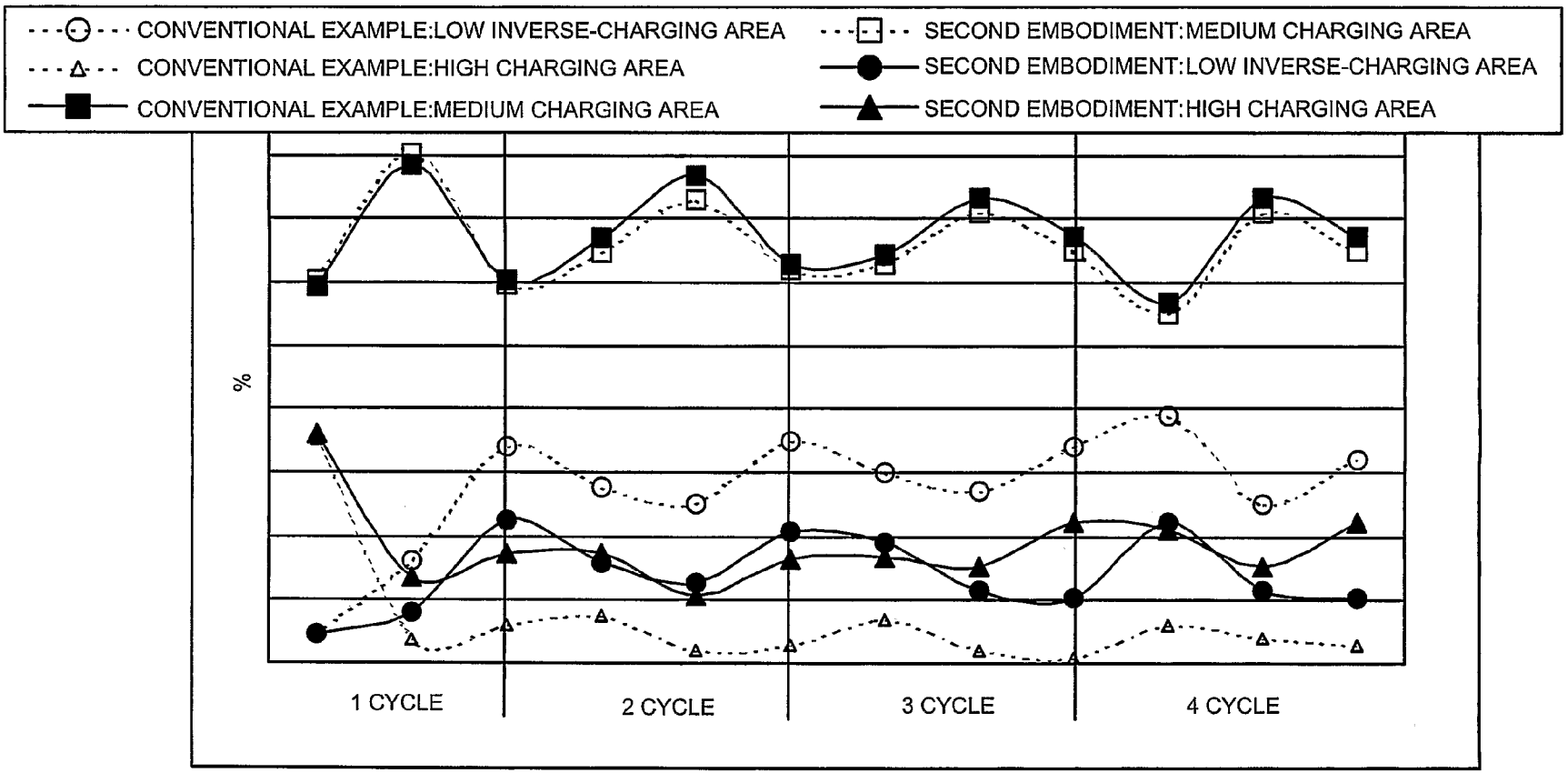
FIG. 21 is a graph of a result after 4-cycle execution.

FIG. 21 is a graph of a result after 4-cycle execution, taking (a) to (c) as one cycle. In the second to the fourth cycles, the evaluation of the toner charging amount was performed also at an intermediate time between (a) and (b), and a result of the evaluation was added.

For all of the four cycles, compared with the conventional developing device, the developing device 300 according to the second embodiment can reduce changes of percentages of the toners in the high charging area and the low inverse-charging area, making it possible to stabilize the toner charging amount on the developing sleeve 31*a* over a long period of time.

INDUSTRIAL APPLICABILITY

The developing device, the image forming apparatus, and the process cartridge according to the present invention is useful in forming images by an electrostatic copying process, and particularly useful in preventing a decrease in chargeability and flowability of toner.

The invention claimed is:

1. A developing device comprising:

a developing unit;

a toner cartridge that is detachably arranged in parallel with the developing unit, the toner cartridge supplying toner to the developing unit; and an opening that is disposed between the developing unit and the toner cartridge, through which the toner passes, for supplying the toner to the developing unit and discharging toner from the developing unit to the toner cartridge, wherein the developing unit includes a developer carrier that develops a latent image on an image carrier with toner, a conveying paddle that supplies the toner from the toner cartridge to the developer carrier, and a first control valve disposed adjacent to the opening, the first control valve having a moving part disposed such that in a first position the moving part is in an undeformed state and contacts the conveying paddle, and in a second position the moving part is elastically deformed toward the opening, and a supporting part, fixedly attached at the opening and supporting the moving part, and wherein the conveying paddle contacts the moving part while rotating and elastically deforms the moving part toward the opening, such that toner is discharged from the developing unit into the toner cartridge through the opening.

2. The developing device according to claim 1, wherein a space within the toner cartridge allows the toner to flow into the toner cartridge from the developing unit.

3. The developing device according to claim 2, wherein the toner cartridge further includes a rotating body that rotates inside the toner cartridge.

4. The developing device according to claim 3, wherein the toner cartridge further includes a space forming unit, the space forming unit including a second control valve that forms the space in the toner in cooperation with the rotating body.

5. The developing device according to claim 4, wherein the second control valve performs a reciprocating motion by a rotation of the rotating body, to form the space in the toner.

6. The developing device according to claim 5, wherein the rotating body is formed with a bendable film, and rotates at a rotation frequency of 0.04 hertz to 0.4 hertz, and the second control valve forms the space in the toner by making a contact with the rotating body.

7. The developing device according to claim 6, wherein the space forming unit includes a plate member provided on an inner wall of the toner cartridge, and the rotating body contacts the plate member while rotating.

8. The developing device according to claim 7, wherein the rotating body rotates in contact with the inner wall from an upstream of the opening in a direction of the rotation, and passes over the opening.

9. The developing device according to claim 8, wherein a length of the film is 110% to 170% of a distance from a center of the rotating body to the inner wall.

10. The developing device according to claim 9, wherein the plate member is provided in a range of −30% to +30% of the distance from the center of the rotating body to the inner wall, from a position right below the rotating body.

11. The developing device according to claim 10, wherein the film is longer than a distance from the center of the rotating body to an edge of the opening by 10 millimeters or more.

12. The developing device according to claim 11, wherein a plurality of the openings is provided in the developing device.

13. An image forming apparatus comprising:

a charging unit that charges a surface of an image carrier that carries a latent image;

an exposing device that forms an electrostatic latent image on the surface of the image carrier charged by the charging unit;

a developing device that visualizes the electrostatic latent image formed on the surface of the image carrier, to form a visual image;

a transferring device that transfers the visible image from the image carrier onto a recording medium directly or via an intermediate transfer member; and a fixing device that fixes the visible image transferred onto the recording medium by using a heat or a pressure, wherein the developing device includes:

a developing unit;

a toner cartridge that is detachably arranged in parallel with the developing unit, the toner cartridge supplying the toner to the developing unit; and an opening that is disposed between the developing unit and the toner cartridge, through which the toner passes, for supplying the toner to the developing unit and discharging toner from the developing unit to the toner cartridge, wherein the developing unit has a developer carrier that develops a latent image on an image carrier with toner, a conveying paddle that supplies the toner from the toner cartridge to the developer carrier, and a first control valve disposed adjacent to the opening, the first control valve having a moving part disposed such that in a first position the moving part is in an undeformed state and contacts the conveying paddle, and in a second position the moving part is elastically deformed toward the opening, and a supporting part, fixedly attached at the opening and supporting the moving part, and wherein the conveying paddle contacts the moving part while rotating and elastically deforms the moving part toward the opening, such that toner is discharged from the developing unit into the toner cartridge through the opening.

14. The image forming apparatus according to claim 13, further comprising:

a process cartridge that integrally supports the image carrier and the developing device, the process cartridge being detachably attached to the image forming apparatus.

15. A process cartridge that integrally supports at least an image carrier and a developing device, the process cartridge being detachably attached to an image forming apparatus, wherein the developing device includes a developing unit;

a toner cartridge that is detachably arranged in parallel with the developing unit, the toner cartridge supplying the toner to the developing unit; and an opening that is disposed between the developing unit and the toner cartridge, through which the toner passes, for supplying the toner to the developing unit and discharging toner from the developing unit to the toner cartridge, wherein the developing unit has a developer carrier that develops a latent image on an image carrier with toner, a conveying paddle that supplies the toner from the toner cartridge to the developer carrier, and a first control valve disposed adjacent to the opening, the first control valve having a moving part disposed such that in a first position the moving part is in an undeformed state and contacts the conveying paddle, and in a second position the moving part is elastically deformed toward the opening, and a supporting part, fixedly attached at the opening and supporting the moving part, and wherein the conveying paddle contacts the moving part while rotating and elastically deforms the moving part toward the opening, such that toner is discharged from the developing unit into the toner cartridge through the opening.

* * * * *